US007733363B2

(12) United States Patent
Sowa et al.

(10) Patent No.: US 7,733,363 B2
(45) Date of Patent: Jun. 8, 2010

(54) LINE HEAD AND IMAGE FORMING DEVICE USING THE SAME

(75) Inventors: Takeshi Sowa, Matsumoto (JP); Yujiro Nomura, Shiojiri (JP); Ryuta Koizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/208,208

(22) Filed: Sep. 10, 2008

(65) Prior Publication Data

US 2009/0066779 A1 Mar. 12, 2009

(30) Foreign Application Priority Data

Sep. 11, 2007 (JP) ..... 2007-235432
May 19, 2008 (JP) ..... 2008-130591

(51) Int. Cl.
*B41J 2/45* (2006.01)

(52) U.S. Cl. ..... 347/238

(58) Field of Classification Search ..... 347/230, 347/234, 241, 243, 244, 256, 258, 238
See application file for complete search history.

(56) References Cited

U.S. PATENT DOCUMENTS 4,253,102 A * 2/1981 Kataoka et al. ..... 347/234
4,474,422 A * 10/1984 Kitamura ..... 359/204.1
5,870,132 A * 2/1999 Inoue et al. ..... 347/243

FOREIGN PATENT DOCUMENTS

JP 02-004546 1/1990
JP 06-278314 10/1994
JP 06-344596 12/1994

* cited by examiner

*Primary Examiner*—Hai C Pham
(74) *Attorney, Agent, or Firm*—Hogan & Hartson LLP

(57) ABSTRACT

A line head includes a lens array having a plurality of positive lens systems in a first direction. Each positive lens system has a pair of lenses with positive refractive power. A light emitter array disposed on an object side of the lens array has a plurality of light emitting elements disposed corresponding to the positive lens systems. An aperture plate forms an aperture stop on the object side of the pair of lenses. A focal distance $f_1$ of one of the pair of lenses disposed on the object side satisfies the conditional formula $f_1 \leqq d_0/(1+W_0/D_1)$.

8 Claims, 26 Drawing Sheets

LINE HEAD AND IMAGE FORMING DEVICE USING THE SAME

CROSS-REFERENCE TO RELATED APPLICATIONS

This application claims the benefit of priority under 35 USC 119 of Japanese patent application no. 2007-235432, filed on Sep. 11, 2007, and Japanese patent application no. 2008-130591, filed on May 19, 2008, which are hereby incorporated by reference.

BACKGROUND

1. Technical Field

The present invention relates to a line head and an image forming device using the same, and in particular to a line head, which projects an image of a light emitting element array on a projection surface using a microlens array to form an imaging spot array, and an image forming device using the line head.

2. Related Art

JP-A-2-4546 proposes an optical writing line head having a plurality of LED array chips disposed in an LED array direction, enlargedly projecting the image of the LED array chips on a photoconductor using a positive lens disposed corresponding to the LED array chips, and thereby forming images of the light emitting dots at the ends of the adjacent LED chips so as to be adjacent to each other on the photoconductor with a distance identical to a pitch between the images of the light emitting dots of the same LED array chip, and also proposes a device using the optical writing line head as an optical reading line head with the optical path reversed.

Further, JP-A-6-344596 proposes composing the positive lens of JP-A-2-4546 as a pair of lenses so as to approximate the projection light to collimated light, thereby increasing the focal depth.

Further, JP-A-6-278314 proposes an optical writing line head having LED array chips arranged in two lines with a distance, shifting the phases of the repeated arrangements of the tow lines a half cycle from each other, and having positive lens arrays arranged in two lines corresponding to the LED array chips so that the images of the light emitting dot arrays on the photoconductor are arranged in a line.

In these past technologies, although arrays of positive lenses (systems) corresponding to the arrangement of the LED arrays are used, there is a cross talk problem that a light beam from a light emitting dot outside the axis of the LED array enters a positive lens (system) adjacent to the corresponding positive lens (system) in the lens array instead of the corresponding positive lens (system), and reaches a position different from the predetermined imaging position, which causes ghosting or loss in light intensity to problematically degrade the image quality and reduce the light efficiency.

Further, even in the case in which the images of the light emitting dot arrays are aligned on an ideal image plane at a constant pitch, if the image plane moves back and forth in the optical axis direction of the lens owing to fluctuation of the photoconductor, position error of the light emitting dot on the photoconductor is caused, which problematically causes a variation in the pitch between scan lines drawn by the light emitting dot array relatively moving in the sub-scanning direction (the pitch variation in the main-scanning direction).

SUMMARY

In view of the problems of the past technologies as described above, the invention has an advantage of preventing ghosting or loss of light intensity caused by cross talk in an optical writing line head having a plurality of light emitting elements arranged in columns corresponding to positive lens systems arranged in arrays.

Another advantage of the invention is to prevent the variation caused by the position error of the light emitting dots even if the writing surface varies in the optical axis direction.

Further, it is also an advantage of the invention to provide an image forming device using such an optical writing line head, and an optical reading line head having the optical path reversed.

A line head according to an aspect of the invention obtains the advantage described above and includes a lens array having a plurality of positive lens systems in a first direction, each of the positive lens systems having a pair of lenses with positive refractive power, a light emitter array disposed on an object side of the lens array and having a plurality of light emitting elements disposed corresponding to each of the positive lens systems, and an aperture plate forming an aperture stop on the object side of the pair of lenses, and where $f_1$ denotes a focal distance of one of the pair of lenses disposed on the object side, the following conditional formula is satisfied:

$$f_1 \leqq d_0/(1+W_0/D_1)$$

where: $d_0$ denotes a distance between the light emitter array and a front principal surface of the lens on the object side; $W_0$ denotes a distance between the light emitting elements out of the plurality of light emitting elements disposed corresponding to each of the positive lens systems and located at both ends of the plurality of light emitting elements disposed corresponding to each of the positive lens systems in the first direction; and $D_1$ denotes an effective diameter of the lens on the object side.

By configuring the line head as described above, the light beam is prevented from entering the adjacent positive lens system of the lens array to cause cross talk, which results in loss of light intensity and reaching the image plane as a ghost.

Further, the aperture stop is preferably disposed at the front focal position of the positive lens system.

By thus configuring the line head, even if the position of the writing surface is shifted in the optical axis direction, no shift of the imaging spot occurs, and degradation of the image formed is prevented.

Further, the positive lens system can be formed with a pair of positive lenses.

A line head according to another aspect of the invention includes a lens array having a plurality of positive lens systems in a first direction, each of the positive lens systems having a pair of lenses with positive refractive power, a light emitter array disposed on an object side of the lens array and having a plurality of light emitting elements disposed corresponding to each of the positive lens systems, and an aperture plate forming an aperture stop on the object side of or between the pair of lenses, and where $f_1$ denotes a focal distance of one of the pair of lenses disposed on the object side, the following conditional formula is satisfied:

$$f_1 \leqq d_0/(1+W_0/D_1)$$

where: $d_0$ denotes a distance between the light emitter array and a front principal surface of the lens on the object side; $W_0$ denotes a distance between the light emitting elements out of the plurality of light emitting elements disposed corresponding to each of the positive lens systems and located at both ends of the plurality of light emitting elements disposed corresponding to each of the positive lens systems in the first direction; and $D_1$ denotes an effective diameter of the lens on the object side.

In this case, the aperture stop is preferably disposed at a front focal position of one of the pair of lenses disposed on an image side.

By thus configuring the line head, even if the position of the writing surface is shifted in the optical axis direction, no shift of the imaging spot occurs, and degradation of the image formed is prevented.

Further, an image side surface of at least the lens on the image side is preferably formed of a flat surface.

By thus configuring the line head, the emission surface of the lens disposed nearest to the image plane is a flat surface, and foreign matters such as dust or toner attached to the emission surface can easily be removed to improve cleanability.

Further, the plurality of light emitting elements preferably forms a plurality of light emitting element rows arranged in a second direction perpendicular to the first direction.

By thus configuring the line head, it is possible to cope with the image formation with high imaging spot density.

Further, the plurality of light emitting elements is preferably arranged to form a light emitter group with intervals in the first direction.

By thus configuring the line head, it is possible to cope with the image formation with high imaging spot density.

An image forming device can be configured using the line head described above. The image forming device includes a latent image holding member, a charging section for charging the latent image holding member, a line head including a lens array having a plurality of positive lens systems in a first direction, each of the positive lens systems having a pair of lenses with positive refractive power, a light emitter array disposed on an object side of the lens array and having a plurality of light emitting elements disposed corresponding to each of the positive lens systems, and an aperture plate forming an aperture stop on the object side of or between the pair of lenses, and satisfying the following conditional formula where $f_1$ denotes a focal distance of one of the pair of lenses disposed on the object side, and a development section for developing the latent image holding member:

$$f_1 \leqq d_0/(1+W_0/D_1)$$

where: $d_0$ denotes a distance between the light emitter array and a front principal surface of the lens on the object side; $W_0$ denotes a distance between the light emitting elements out of the plurality of light emitting elements disposed corresponding to each of the positive lens systems and located at both ends of the plurality of light emitting elements disposed corresponding to each of the positive lens systems in the first direction; and $D_1$ denotes an effective diameter of the lens on the object side.

An image forming device configured in this manner, such as a printer, is small in size, has high resolution, and provides little deterioration in the image.

Another aspect of the invention is a line head provided with a lens array having a plurality of positive lens systems in a first direction, each of the positive lens systems having a pair of lenses with positive refractive power, a light acceptor array disposed on an image side of the lens array and having a plurality of light acceptance elements disposed corresponding to each of the positive lens systems, and an aperture plate forming an aperture stop on the image side of or between the pair of lenses, wherein where $f_1$ denotes a focal distance of one of the pair of lenses disposed on the image side, the following conditional formula is satisfied:

$$f_1 \leqq d_0/(1+W_0/D_1)$$

where: $d_0$ denotes a distance between the light acceptor array and a back principal surface of the lens on the image side; $W_0$ denotes a distance between the light acceptance elements out of the plurality of light acceptance elements disposed corresponding to each of the positive lens systems and located at both ends of the plurality of light acceptance elements disposed corresponding to each of the positive lens systems in the first direction; and $D_1$ denotes an effective diameter of the lens on the image side.

By configuring a line head as described above, including an optical reading line head, the light beam is prevented from entering the adjacent positive lens system of the lens array to cause cross talk, which results in loss of light intensity and reaching the image plane as a ghost.

Each of the positive lens systems forming the lens array may also be composed of a pair of lens groups with positive refractive power to be formed as a combination lens system composed of the pair of lens groups (each of the pair of lenses described above is composed of the lens group with positive refractive power).

BRIEF DESCRIPTION OF THE DRAWINGS

The invention is now described with reference to the accompanying drawings, wherein like numbers reference like elements.

DESCRIPTION OF EXEMPLARY EMBODIMENTS

Arrangement and emission timing of light emitting elements of a line head according to an embodiment of the invention is first explained before the optical system of the line head is explained in detail.

Figure 4:
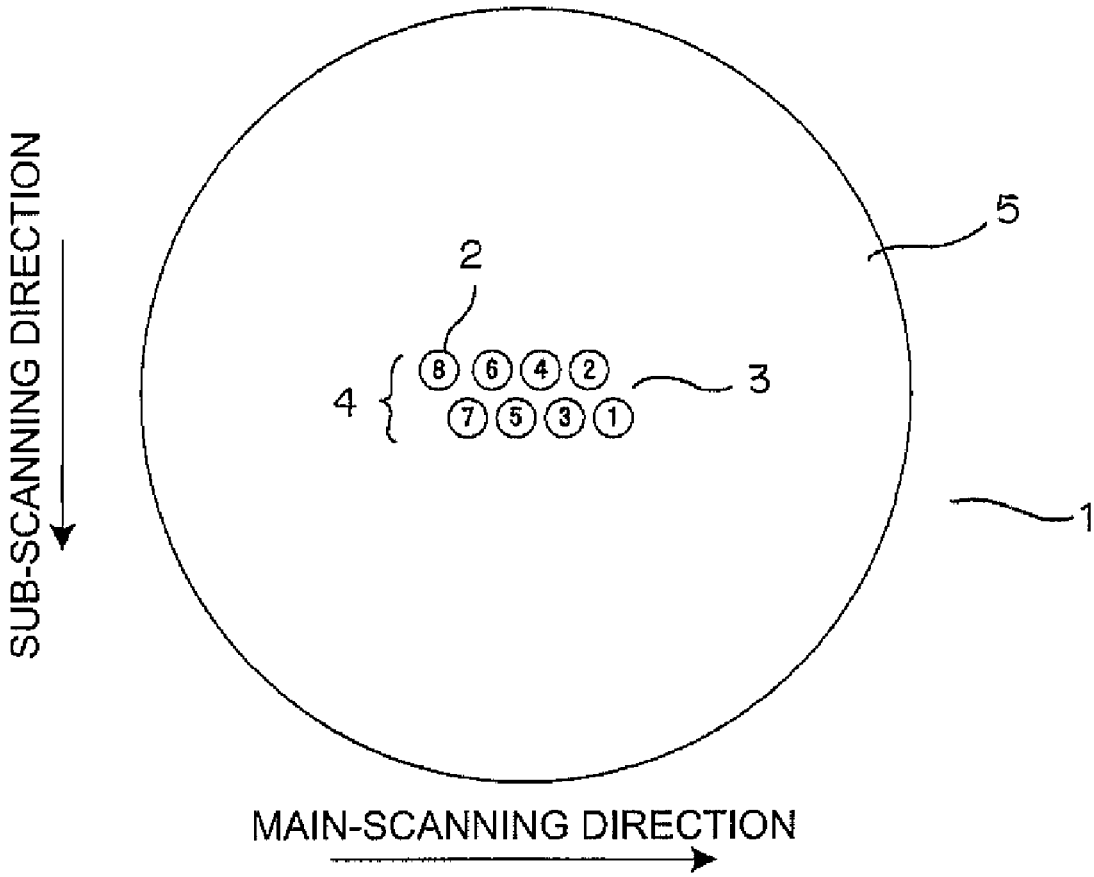
FIG. 4 is an explanatory diagram showing a correspondence between a light emitter array and a microlens with negative magnification according to an embodiment of the invention.

FIG. 4 is an explanatory diagram showing a correspondence between a light emitter array 1 and a microlens 5 with negative magnification according to the embodiment of the invention. In the line head of the present embodiment, two rows of light emitting elements correspond to each microlens 5. Since the microlens 5 is an imaging element with negative (inverted imaging) optical magnification, the positions of the light emitting elements are reversed in both the main-scanning and sub-scanning directions. In other words, in the configuration of FIG. 4, the light emitting elements with even numbers (8, 6, 4, 2) are arranged on the upstream side (the first row) in the moving direction of the image holding member, and the light emitting elements with odd numbers (7, 5, 3, 1) are arranged on the downstream side (the second row). Further, the light emitting element with larger number is arranged on the leading (upstream) side in the main-scanning direction.

Figure 1:
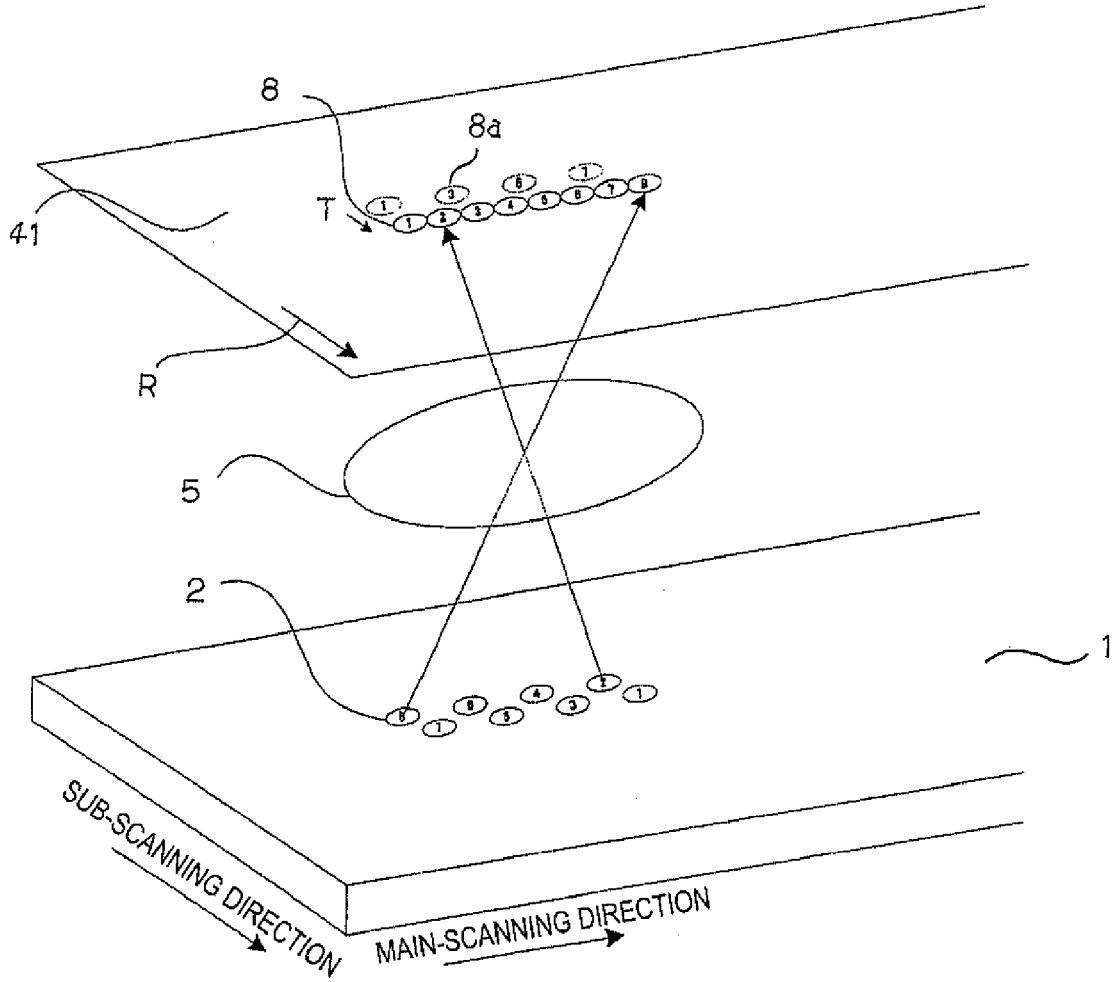
FIG. 1 is a perspective view of a unit microlens of a line head according to an embodiment of the invention.
Figure 2:
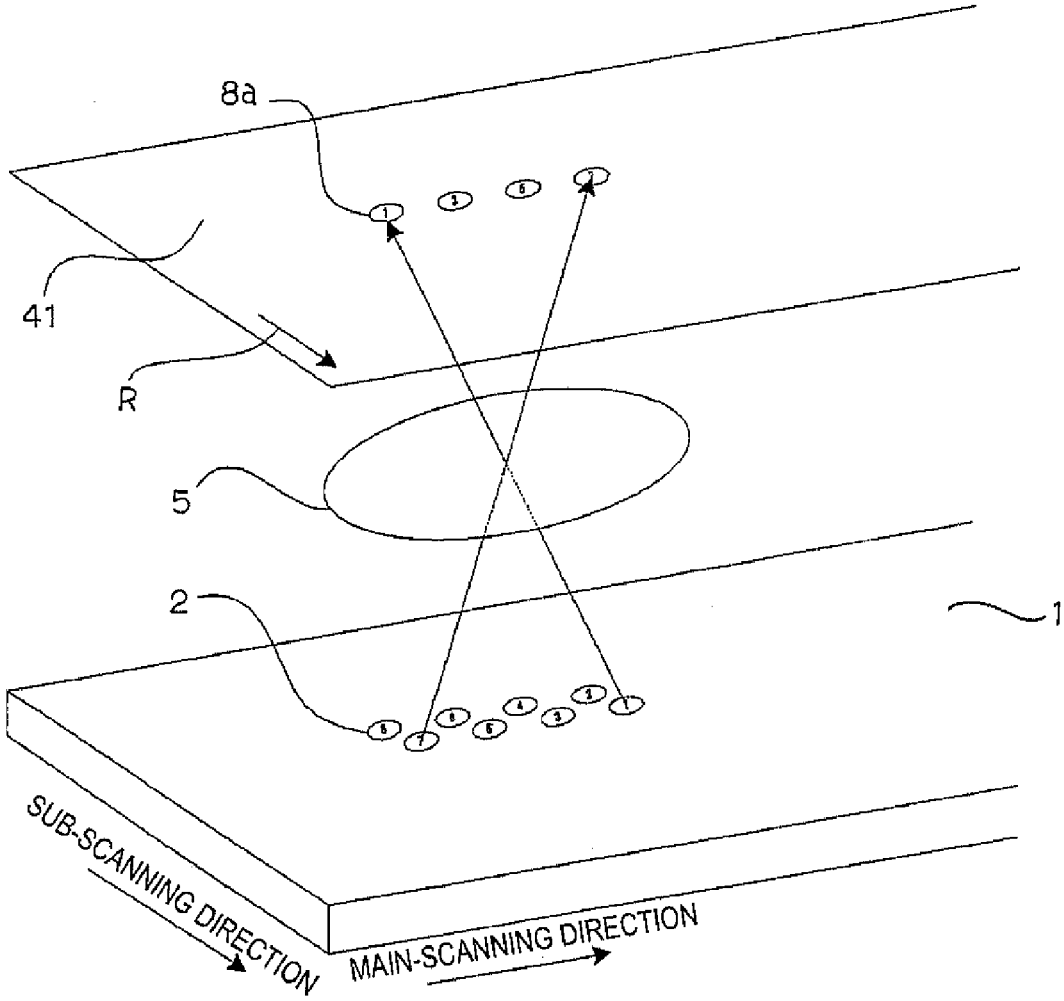
FIG. 2 is a perspective view of a unit microlens of a line head according to an embodiment of the invention.
Figure 3:
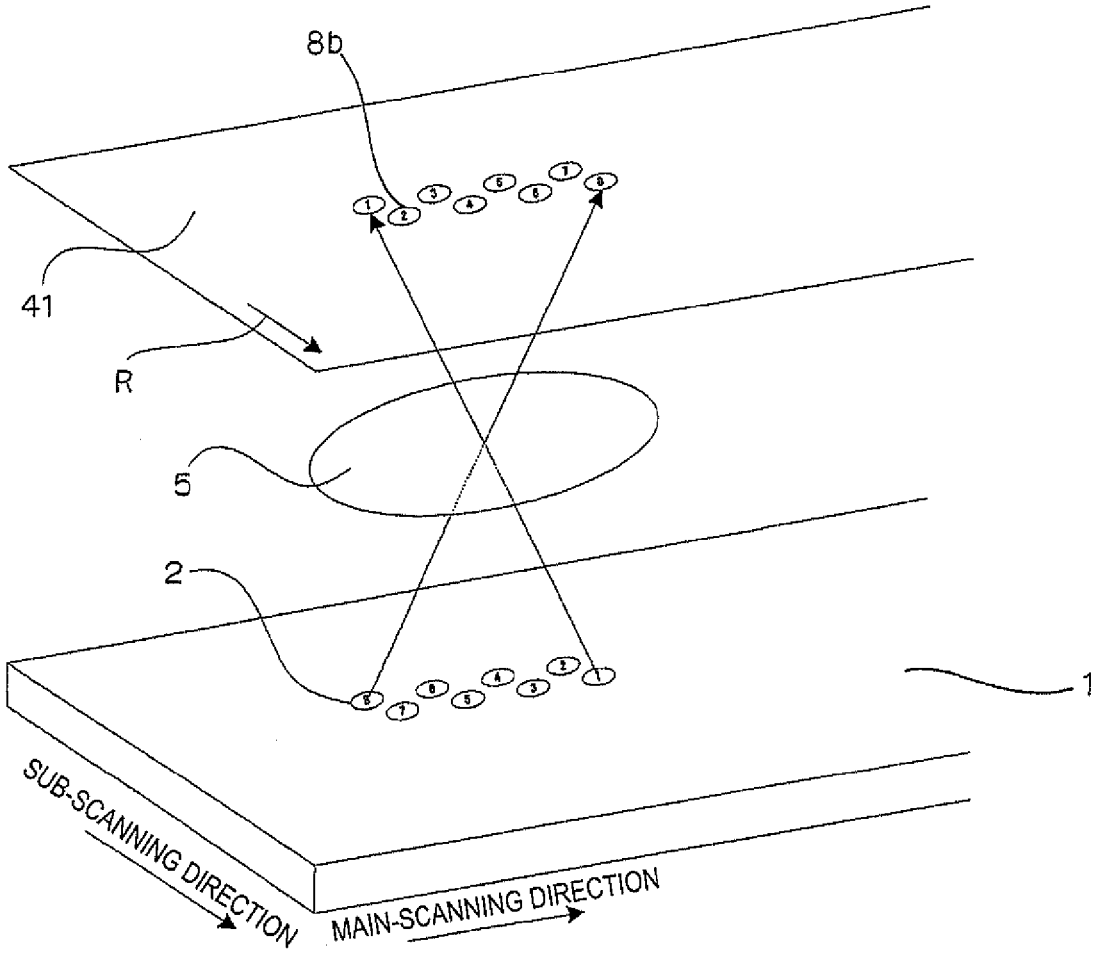
FIG. 3 is a perspective view of a unit microlens of a line head according to an embodiment of the invention.

FIGS. 1-3 are perspective views of a part corresponding to one of the microlenses of the line head according to the present embodiment. As shown in FIG. 2, the imaging spots 8*a* of the image holding member 41 corresponding to the light emitting elements 2 with the odd numbers arranged on the downstream side in the moving direction of the image holding member 41 are formed at the positions reversed in the main-scanning direction. The arrow R denotes the moving direction of the image holding member 41. As shown in FIG. 3, the imaging spots 8*b* of the image holding member 41 corresponding to the light emitting elements 2 with the even numbers arranged on the upstream side (the first row) in the moving direction of the image holding member 41 are formed at positions on the downstream side, which is the reverse side in the sub-scanning direction. However, in the main-scanning direction, the positions of the imaging spots arranged from the leading side correspond to the light emitting elements with the numbers from one to eight in number order. Therefore, in this example, the imaging spots can be formed in the main-scanning direction on the same row by adjusting the timing of forming the imaging spots in the sub-scanning direction of the image holding member.

Figure 5:
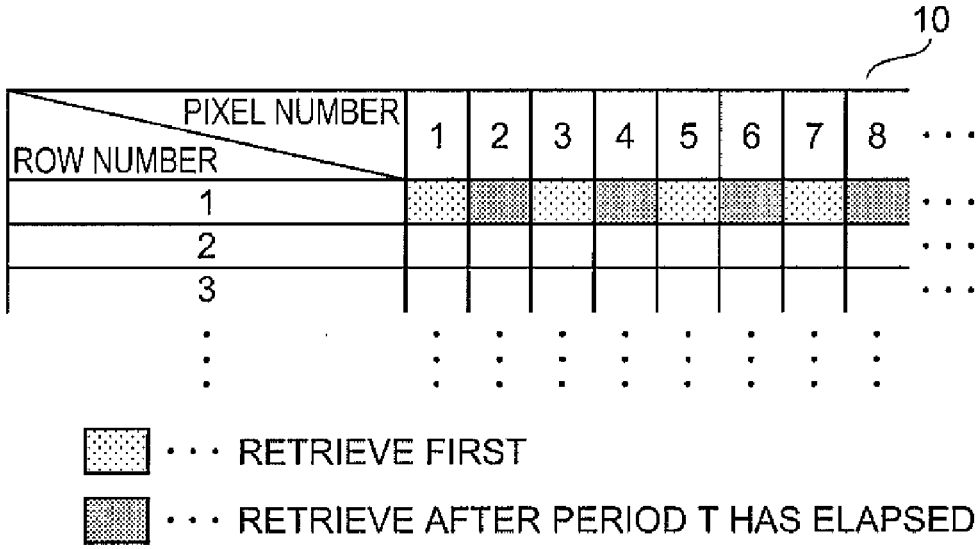
FIG. 5 is an explanatory diagram showing an example of a memory table of a line buffer in which image data is stored.

FIG. 5 is an example of a memory table 10 of a line buffer in which image data is stored. In the memory table 10, the image data is stored in the reverse order in the main-scanning direction in accordance with the numbers of the light emitting elements shown in FIG. 4. The image data with the first pixel numbers (1, 3, 5, 7) corresponding to the light emitting elements on the downstream side (the second row) in the moving direction of the image holding element 41 are firstly retrieved to make the light emitting elements emit light. Then, after the period T has elapsed, the image data with the second pixel numbers (2, 4, 6, 8) stored in the memory table 10 and corresponding to the light emitting elements on the upstream side (the first row) in the moving direction of the image holding element 41 are retrieved to make the light emitting elements emit light. Through the process described above, the imaging spots corresponding to the light emitting elements in the first row and the imaging spots corresponding to the light emitting elements in the second row are formed on the image holding member in the same row in the main-scanning direction as denoted with the reference numeral 8 shown in FIG. 6.

Figure 6:
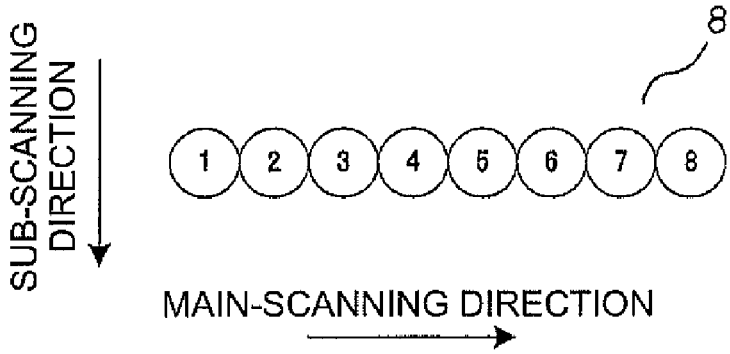
FIG. 6 is an explanatory diagram showing a condition in which imaging spots caused by odd number light emitting elements and even number light emitting elements are formed in the same column in a main scanning direction.

FIG. 1 conceptually shows an example of retrieving the image data with the timing explained with reference to FIG. 5 to form the imaging spots. As explained with reference to FIG. 5, the light emitting elements on the downstream side (the second row) in the moving direction of the image holding member 41 are first made to emit light to form the imaging spots on the image holding member 41. After the predetermined period T of time has elapsed, the light emitting elements with the even numbers on the upstream side (the first row) in the moving direction of the image holding member 41 are made to emit light to form the imaging spots on the image holding member 41. On this occasion, the imaging spots formed by the light emitting elements with the even numbers are to be formed at the positions 8 in the same row as shown in FIG. 6 instead of the positions 8*b* explained with reference to FIG. 3.

Figure 7:
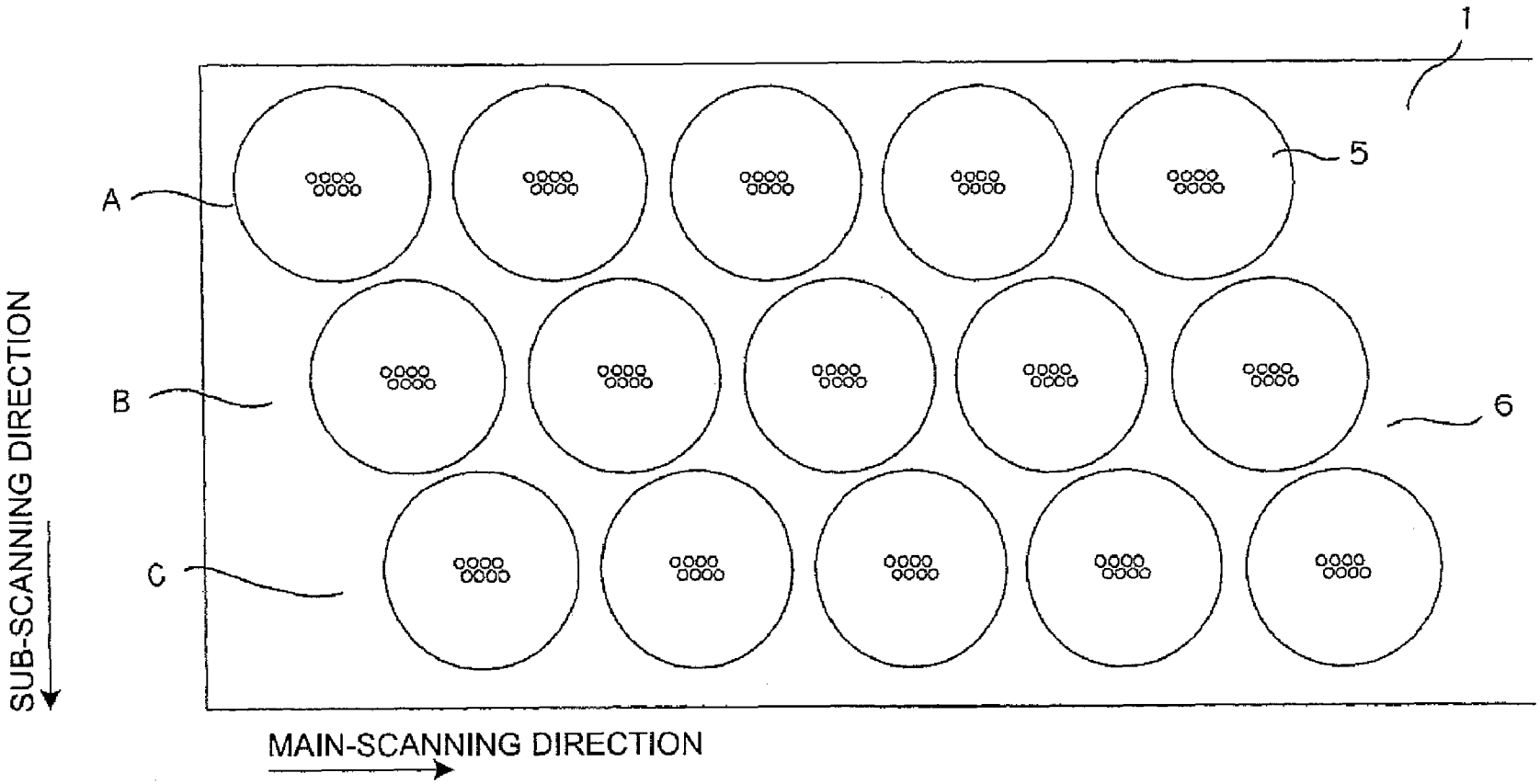
FIG. 7 is a schematic explanatory diagram showing an example of a light emitter array used as a line head.

FIG. 7 shows an example of a light emitter array 1 used as the line head. In the light emitter array 1, light emitter blocks 4 (FIG. 4) are formed each provided with a plurality of light emitting element rows 3 in the sub-scanning direction, each having a plurality of light emitting elements 2 arranged in the main-scanning direction. In FIG. 7, the light emitter block 4 is provided with a pair of light emitting element rows 3 formed in the sub-scanning direction, each having four light elements 2 arranged in the main-scanning direction (FIG. 4). A plurality of light emitter blocks 4 is arranged in the light emitter array 1 corresponding respectively to the microlenses 5.

The microlenses 5 are arranged in both the sub-scanning and main-scanning directions of the light emitter array 1 to form the microlens array (MLA) 6. In the MLA 6, the microlenses 5 are arranged so that the leading positions in the rows arranged in the sub-scanning direction are shifted from each other in the main-scanning direction. Such an arrangement of the microlenses 5 in the MLA 6 corresponds to the case in which the light emitting elements are provided to the light emitter array 1 in a zigzag manner. In the example shown in FIG. 7, the microlenses 5 of the MLA 6 are arranged in three rows arranged in the sub-scanning direction, and therefore, the light emitter blocks 4 are divided into three groups A, B and C corresponding respectively to positions of the three rows in the sub-scanning direction.

As described above, in the case in which a plurality of light emitting elements 2 is disposed in each of the microlenses 5 with negative optical magnification, and the microlenses 5 are arranged in two or more rows arranged in the sub-scanning direction, the image data control such as (1) reversal in the sub-scanning direction, (2) reversal in the main-scanning direction, (3) emission timing control of the plurality of rows of the light emitting elements in the lens, and (4) emission timing adjustment of the light emitting elements between the groups becomes necessary for forming the imaging spots aligned in the same row in the main-scanning direction of the image holding member 41.

Figure 8:
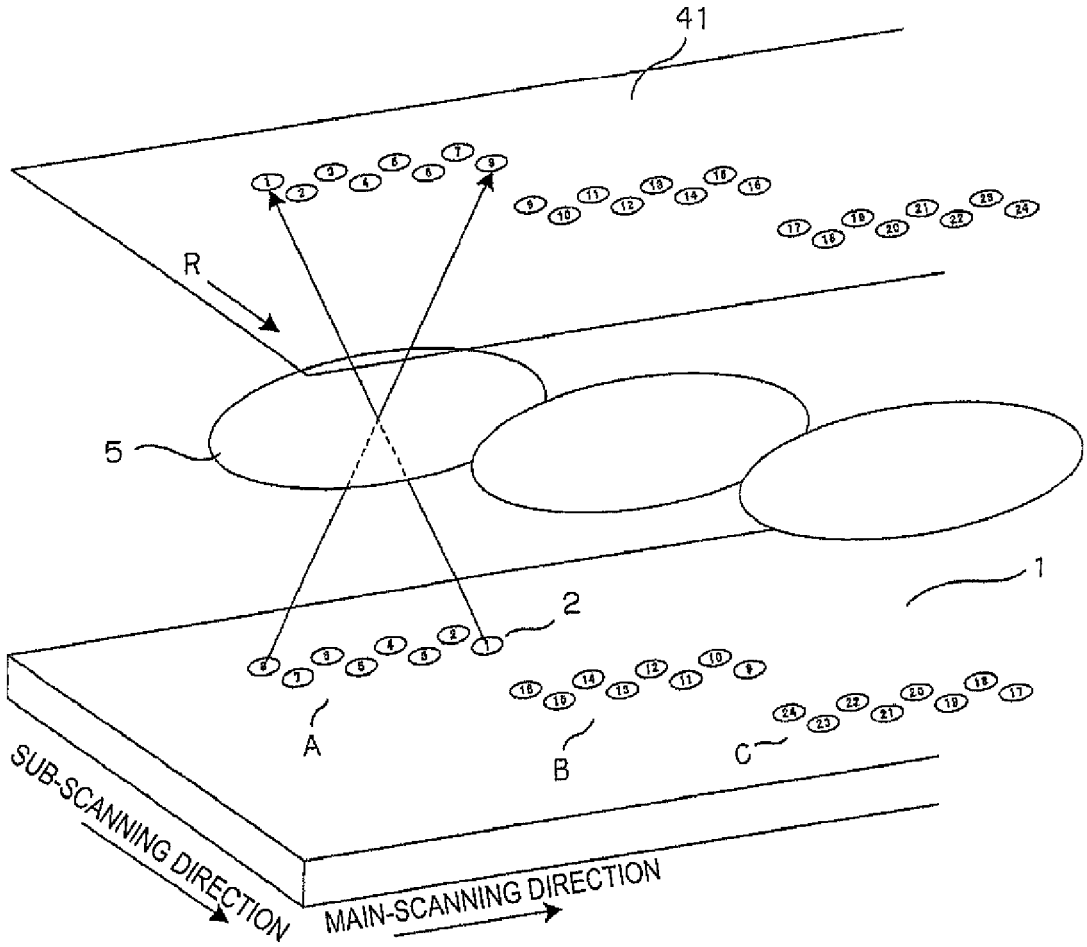
FIG. 8 is an explanatory diagram showing the imaging positions in the case in which the exposure surface of an image holding member is irradiated by the output light of each of the light emitting elements through the microlens in the configuration of FIG. 7.

FIG. 8 shows the imaging positions in the case in which the exposure surface of the image holding member is irradiated by the output light of each of the light emitting elements 2 through the microlens 5 in the configuration of FIG. 7. As shown in FIG. 7 and FIG. 8, light emitter blocks 4 divided into the groups A, B and C are disposed in the light emitter array 1. The light emitting element rows of each of the light emitter blocks 4 of the groups A, B and C are divided into the upstream side (the first row) and the downstream side (the second row) in the moving direction of the image holding member 41, and the light emitting elements with the even numbers are assigned to the first row while the light emitting elements with the odd numbers are assigned to the second row.

Regarding the group A, by operating the light emitting elements 2 as explained with reference to FIGS. 1-3, the imaging spots are formed on the image holding member 41 at the positions reversed in both of the main-scanning direction and the sub-scanning direction. By such an operation, the imaging spots are formed on the image holding member 41 in the same row in the main-scanning direction in the order of numbers from 1 to 8. Subsequently, after moving the image holding member 41 in the sub-scanning direction for a predetermined period of time, the processing of the group B is executed in a similar manner. By executing the processing of the group C after further moving the image holding member 41 in the sub-scanning direction for the predetermined period of time, the imaging spots based on the image data input are formed in the same row in the main-scanning direction in the order of the numbers from 1 to 24.

Figure 9:
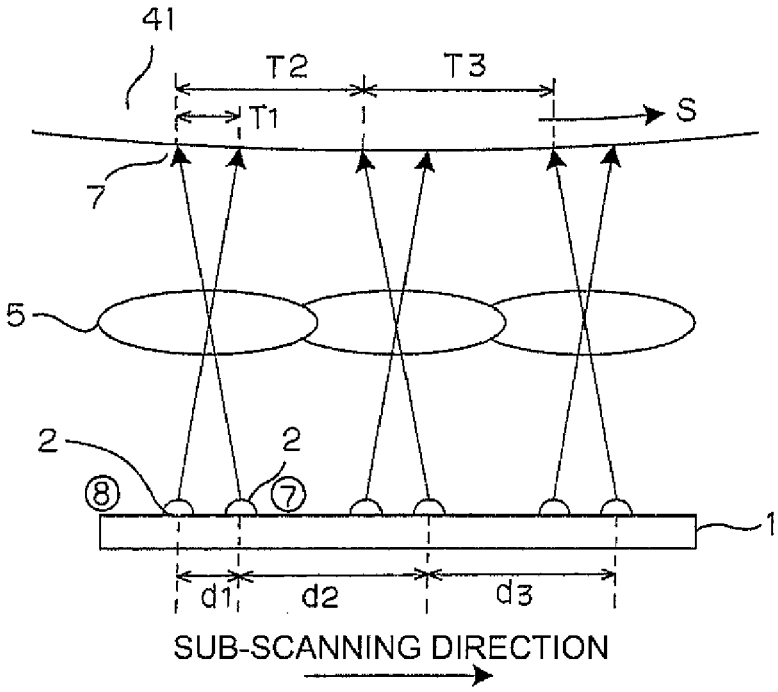
FIG. 9 is an explanatory diagram showing the condition of the imaging spot formation in the sub-scanning direction in FIG. 8.

FIG. 9 shows the condition of the imaging spot formation in the sub-scanning direction in FIG. 8. The arrow S denotes the moving speed of the image holding member 41; d1 denotes the distance between the light emitting elements in the first row and the light emitting elements in the second row of the group A; d2 denotes the distance between the light emitting elements in the second row of the group A and the light emitting elements in the second row of the group B; d3 denotes the distance between the light emitting elements in the second row of the group B and the light emitting elements in the second row of the group C; T1 denotes the time period from when the light emitting elements in the second row of the group A emit light to when the light emitting elements in the first row thereof emit light; T2 denotes the amount of time necessary for the imaging spots formed by the light emitting elements in the second row of the group A to move to the positions in the same row as the imaging spots formed by the light emitting elements in the second row of the group B; and T3 denotes the amount of time necessary for the imaging spots formed by the light emitting elements in the second row of the group B to move to the positions in the same row as the imaging spots formed by the light emitting elements in the second row of the group C.

T1 is obtained as follows. T2 and T3 are obtained in a similar manner by replacing d1 with d2 or d3.

$$T1=|(d1\times\beta)/S|$$

The parameters therein are as follows: d1 denotes a distance between the light emitting elements in the sub-scanning direction; S denotes a moving speed of the imaging surface (the image holding member); β denotes magnification of the lens.

Figure 10:
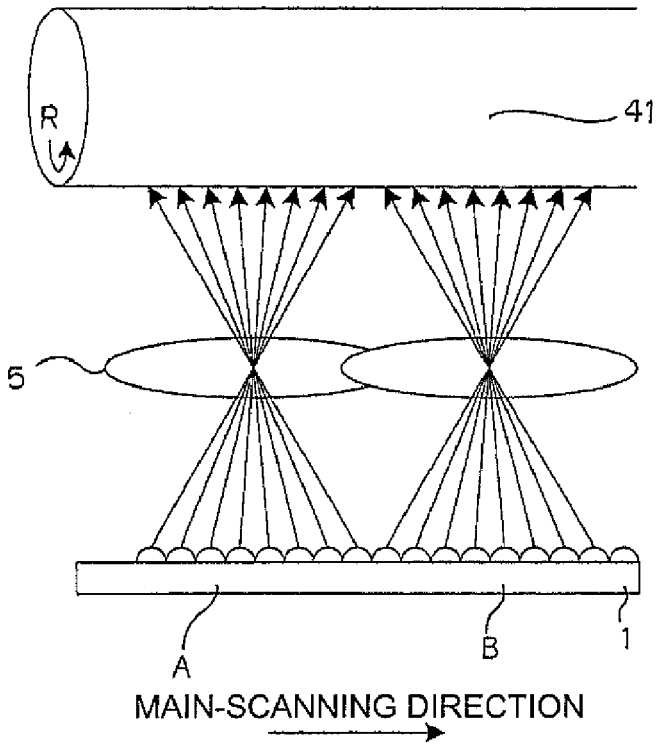
FIG. 10 is an explanatory diagram showing an example in which the imaging spots are formed in the reversed direction of the main-scanning direction of the image holding member in the case in which a plurality of microlenses is arranged.

In FIG. 9, the light emitting elements in the second row of the group B are made to emit light when the time period T2 has elapsed after the light emitting elements in the second row of the group A emitted light. Further, the light emitting elements in the second row of the group C are made to emit light after the time period T3 has elapsed from the end of the time period T2. The light emitting elements in the first row of each group emit light when the time period T1 has elapsed after the light emitting elements in the second row emitted light. By executing such a process, it becomes possible to form the imaging spots in a line on the image holding member by the light emitters disposed two-dimensionally on the light emitter array 1 as shown in FIG. 8. FIG. 10 shows an example in which the imaging spots are formed in the reversed direction of the main-scanning direction of the image holding member in the case in which a plurality of microlenses 5 is arranged.

Figure 11:
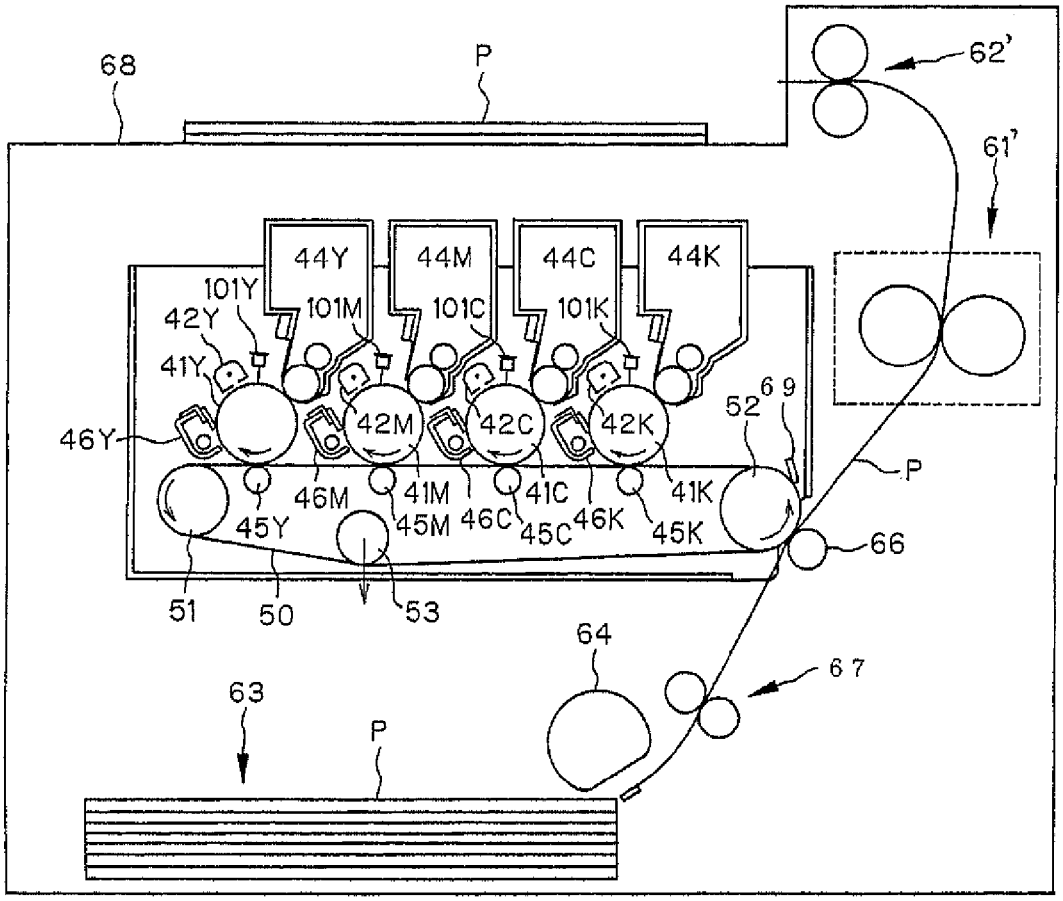
FIG. 11 is a schematic cross-sectional view showing an overall configuration of an example of an image forming device using an electrophotographic process according to an embodiment of the invention.

An image forming device can be configured using the line head described above. In the embodiment of the invention, the line head described above can be used for a tandem color printer (the image forming device) that exposes four photoconductors with four line heads, forms an image with four colors at the same time, and transfers it to one endless intermediate transfer belt (an intermediate transfer medium). FIG. 11 is a vertical cross-sectional side view showing an example of a tandem image forming device using organic EL elements as light emitting elements. This tandem image forming device includes four line heads 101K, 101C, 101M, and 101Y each having the same configuration and disposed at a position for exposing one of four photoconductor drums (image holding members) 41K, 41C, 41M and 41Y each having the same configuration.

As shown in FIG. 11, the image forming device is provided with a drive roller 51, a driven roller 52, a tension roller 53, and an intermediate transfer belt (intermediate transfer medium) 50 stretched across the rollers to be tensioned by the tension roller 53 and circulated in the direction of the arrows (counterclockwise) shown in the drawing. The four photoconductors 41K, 41C, 41M, and 41Y, each having a photoconductor layer on the outer periphery, are disposed along the intermediate transfer belt 50 at predetermined intervals as the four image holding members.

The letters K, C, M and Y added to the reference numerals denote, respectively, black, cyan, magenta and yellow to indicate that the photoconductors are dedicated to these colors. The same lettering scheme is applied to other members. The photoconductors 41K, 41C, 41M, and 41Y are rotationally driven in the direction of the arrows (clockwise) shown in the drawing in sync with driving of the intermediate transfer belt 50. Charging members (corona chargers) 42 (K, C, M, Y) are provided around the photoconductors 41 (K, C, M, Y) for evenly charging the outer peripheral surfaces of the photoconductors 41 (K, C, M, Y), and the line heads 101 (K, C, M, Y) according to the embodiment of the invention as described above for sequentially line-scanning the outer peripheral surfaces evenly charged by the charging members 42 (K, C, M, Y) in sync with the rotation of the photoconductors 41 (K, C, M, Y).

Further, there are provided developing devices 44 (K, C, M, Y) for providing toner as developers to the electrostatic latent image formed by the line heads 101 (K, C, M, Y) to form a visible images (toner images), primary transfer rollers 45 (K, C, M, Y) as transfer sections for sequentially transferring the toner images developed by the developing devices 44 (K, C, M, Y) to the intermediate transfer belt 50 as the primary transfer object, and cleaning devices 46 (K, C, M, Y) as cleaning members for removing toner remaining on the surfaces of the photoconductors 41 (K, C, M, Y) after the transfer process.

The line heads 101 (K, C, M, Y) are disposed so that the array direction of the line heads 101 (K, C, M, Y) is parallel to the generating lines of the photoconductor drums 41 (K, C, M, Y). The peak emission energy wavelengths of the line heads 101 (K, C, M, Y) are substantially equal to the peak sensitivity wavelengths of the photoconductors 41 (K, C, M, Y).

The developing devices 44 (K, C, M, Y) use, for example, non-magnetic monocomponent toner as the developers, feed the monocomponent developers to developing rollers by supply rollers, limit the thicknesses of the developers adhered to the surfaces of the developing rollers by limiting blades, contact or press the developing rollers to or against the photoconductors 41 (K, C, M, Y) to provide the developers to the photoconductors 41 (K, C, M, Y) in accordance with the electrical potential levels thereof, thereby developing the toner images.

The four toner images of black, cyan, magenta, and yellow each formed by the monochromatic toner image forming station are sequentially primary-transferred on the intermediate transfer belt 50 in accordance with the primary transfer bias applied to the primary transfer rollers 45 (K, C, M, Y). The full color toner image formed by sequentially stacking the four toner images of respective colors on the intermediate transfer belt 50 is then secondary-transferred to a recording medium P such as a paper sheet in a secondary-transfer roller 66, and then fixed on the recording medium P bypassing through a fixing roller pair 61' as a fixing section, and then discharged on a paper receiving tray 68 provided to the top section of the device by a paper discharge roller pair 62'.

In FIG. 11, the reference numeral 63 denotes a paper feed cassette in which a number of sheets of recording media P are stacked and held, the reference numeral 64 denotes a pick-up roller for feeding the recording medium P sheet by sheet from the paper feed cassette 63, the reference numeral 65 denotes a gate roller pair for defining feed timing of the recording medium P to the secondary-transfer section of the secondary-transfer roller 66, the reference numeral 66 denotes the secondary-transfer roller as a secondary transfer member forming a secondary-transfer section together with the intermediate transfer belt 50, and the reference numeral 69 denotes a cleaning blade as a cleaning member for removing toner remaining on the surface of the intermediate transfer belt 50 after the secondary-transfer process.

The invention relates to the optical system of the line head (the optical writing line head) as described above.

In the embodiment of the invention, it is assumed that the microlenses 5 forming the microlens array 6 are each composed of a lens system formed of a pair of positive lenses disposed coaxially with each other. The microlenses 5 are each more preferably composed of a pair of positive lenses as described above, from a viewpoint of freedom of aberration correction.

Further, in the embodiment of the invention, the light beam output from the most off-axis light emitting element 2 of the light emitter block 4 corresponding to one microlens 5 is prevented from entering the adjacent microlens 5 instead of the corresponding microlens 5. The principle therefor is explained using the explanatory diagrams of FIGS. 12-14.

Figure 12:
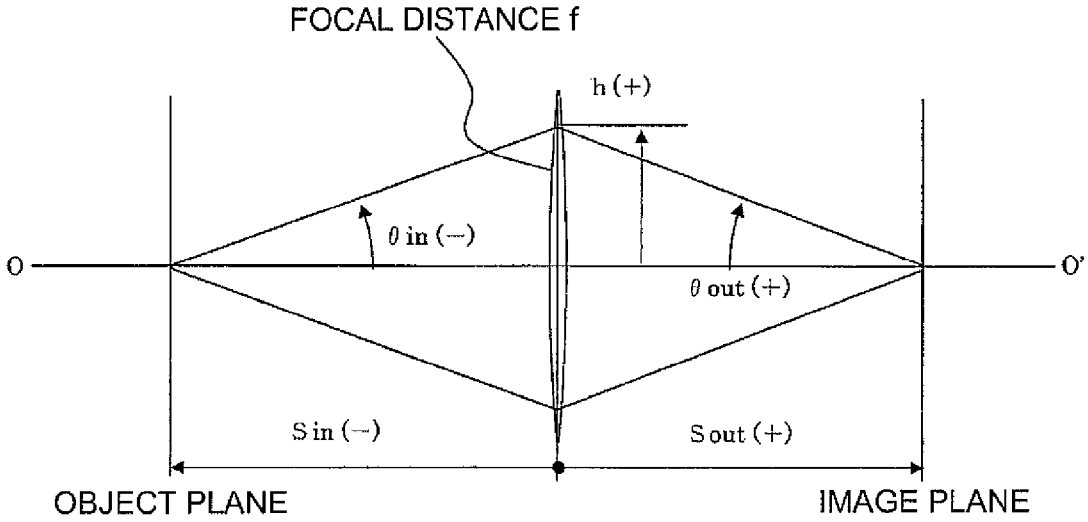
FIG. 12 is a diagram showing the definitions of the signs of respective parameters.

A pair of positive lenses forming the microlens 5 are assumed to be thin lenses. The signs of the respective parameters are defined as shown in FIG. 12 and as follows. The sign of an angle θ measured clockwise based on the optical axis O-O' is positive; the sign of the height measured upward based on the optical axis O-O' is positive; and the sign of the distance measured rightward from the thin lens along the optical axis O-O is positive. The subscripts "in" attached to symbols denote the parameters on the object side, and the subscripts "out" attached to symbols denote the parameters on the image plane side. Further, f denotes the focal distance, h denotes the beam height, and S denotes the on-axis distance.

In order to prevent the light beam from entering the adjacent microlens 5 to cause cross talk, thus causing loss of light intensity and reaching the image plane as a ghost, it is sufficient to prevent the light beam from entering the adjacent second lens on the image side out of the pair of positive lenses forming the microlens 5. If the light beam having a path the farthest from the optical axis on the second lens on the image side becomes parallel to the optical axis or comes closer to the optical axis as the light beam proceeds after the light beam is emitted from the first lens on the object side, loss of light intensity and the ghost caused by the light beam running off on the second lens to the adjacent microlens 5, and thus an image defect, can be prevented.

Attention is now focused on the light beam passing the farthest path from the optical axis on the second lens.

With reference to FIG. 12, the paraxial lens formula is represented as follows assuming that the focal distance of the lens is f.

$$1/S_{out}=1/S_{in}+1/f \quad (1)$$

When multiplying both sides of the paraxial lens formula by the height h of the path that the light beam passes through on the lens, the following formula is obtained.

$$h/S_{out}=h/S_{in}+h/f \quad (2)$$

In the formula (2), by substituting $h/S_{out}=\tan(0_{out})$, $h/S_{in=tan(\Theta in)}$, and then putting the terms in order approximating that $\tan(\theta)=\theta$ because of the paraxial analysis, the following formula is obtained.

$$\theta_{out}=\theta_{in}h/f \quad (3)$$

Figure 13:
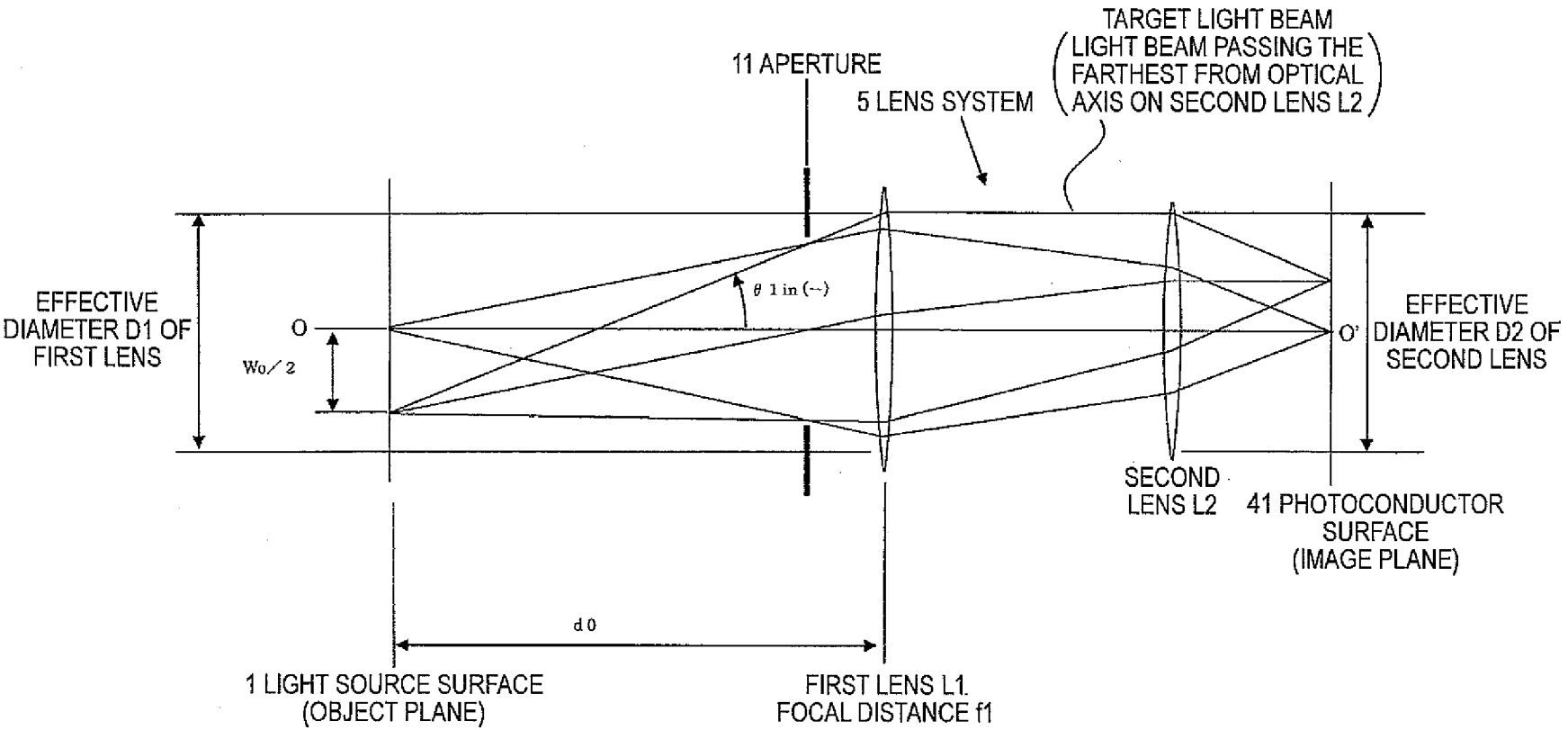
FIG. 13 is a diagram for explaining the principle of the invention in the case in which an aperture stop is located on the object side of two positive lenses forming the microlens.

The parameters $\theta_{1out}$, $\theta_{1in}$, $h_1$, and $f_1$ around the first lens L1 of the lens system 5 in the case in which the aperture stop 11 is located in front (the object side) of the first lens L1 as shown in FIG. 13 will be substituted for the parameters in the formula (3). Assuming that $\theta_{1in}$ represents the angle formed between the incident light beam to the first lens L1 and the optical axis O-O', $\theta_{1out}$ represents the angle formed between the emitted light beam from the first lens L1 and the optical axis 0-0', $h_1$, represents the height of the path that the light beam passes through of the first lens L1, and $f_1$ represents the focal distance of the first lens L1, the following formula is obtained.

$$\theta_{1out}=\theta_{1in}+h_1/f_1 \quad (4)$$

Assuming that the light emitting element group width between the most off-axis light emitting elements 2 in the light emitter block 4 corresponding to the lens system (the microlens) 5 is $W_0$, the effective diameter of the first lens L1 is $D_1$, and the distance between the light emitter array 1 (the light source) and the first lens L1 is $d_0$, the following formulas are obtained.

$$h_1=D_1/2 \quad (5)$$

$$\theta_{1in}=-(D_1/2+W_0/2)/d_0 \quad (6)$$

Further, assuming that the light beam emitted from the first lens L1 is parallel to the optical axis O-O', or proceeds in a direction coming closer to the optical axis O-O', the following is obtained.

$$\theta_{1out}\geqq 0 \quad (7)$$

When the formulas (5)-(7) are applied to the formula (4), the following is obtained.

$$0\leqq-(D_1/2+W_0/2)/d_0+D_1/(2\cdot f_1) \quad (8)$$

Further, by putting the formula (8) in order with respect to $f_1$, the following is obtained.

$$f_1\leqq d_0/(1+W_0/D_1) \quad (9)$$

When the formula (9) is satisfied, the light beam emitted from the first lens L1 proceeds in parallel to the optical axis O-O' or in the direction coming closer to the optical axis O-O', and enters the second lens L2 to image on the photoconductor surface (the image plane) 41. Therefore, the light beam is prevented from running off to the adjacent microlens (the lens system) 5 to cause cross talk.

Figure 14:
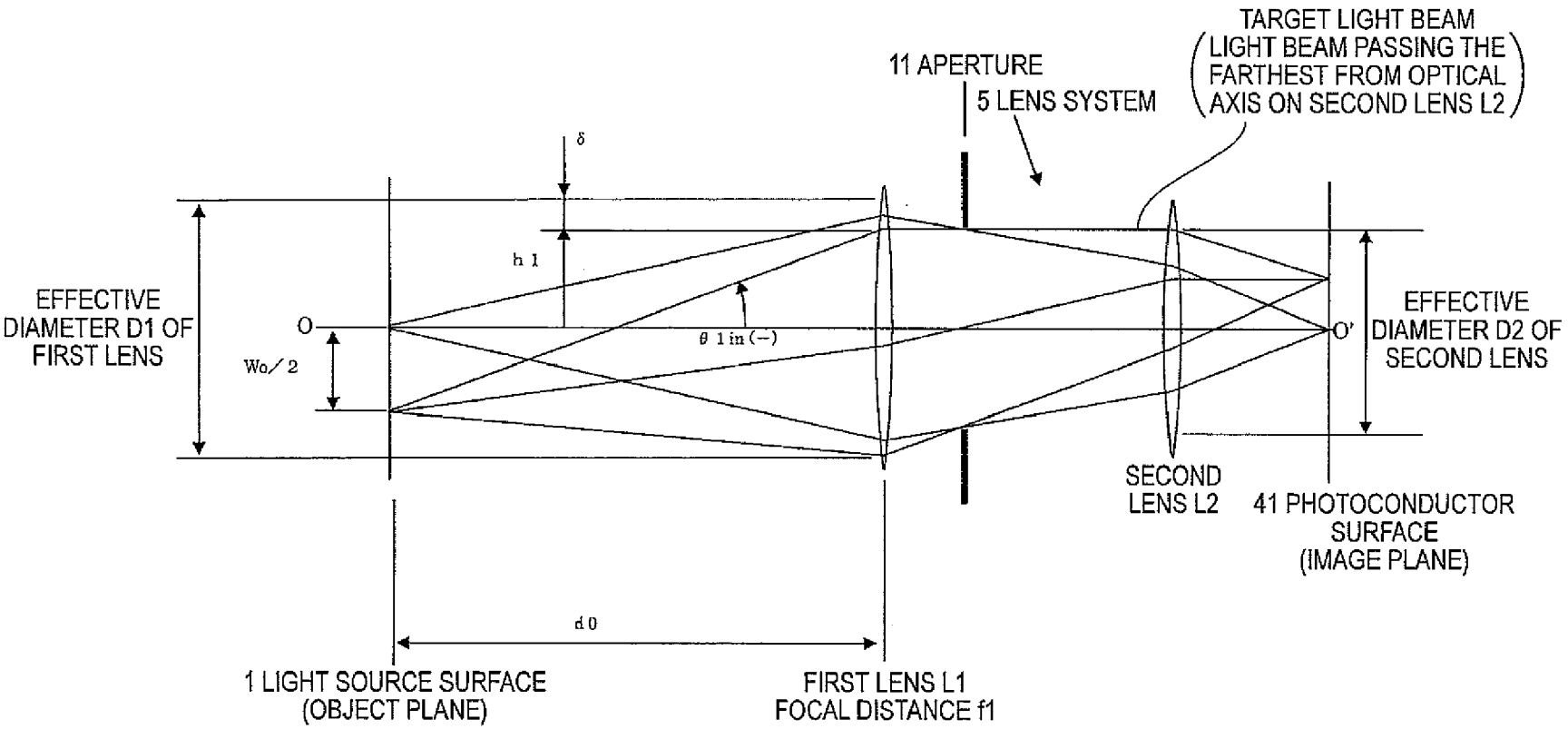
FIG. 14 is a diagram for explaining the principle of the invention in the case in which the aperture stop is located between the two positive lenses forming the microlens.

A case in which the aperture stop 11 is disposed between the first lens L1 and the second lens L2 as shown in FIG. 14 is now considered. Assuming that the difference between "a half of the effective diameter of the first lens L1, namely $D_1/2$" and "the incident height h of the light beam in the first lens L1 passing through the farthest light path from the optical axis O-O' on the second lens L2" is δ, the formulas (5) and (6) can be expressed as follows.

$$h_1+\delta=D_1/2 \quad (5')$$

$$\theta_{1in}=-(h_1/2+W_0/2)/d_0 \quad (6')$$

When the formulas (5'), (6'), and (7) are applied to the formula (4), the following is obtained.

$$0\leqq-(D_1/2-\delta+W_0/2)/d_0+(D_1/2-\delta)/f_1 \quad (10)$$

Further, by putting the formula (10) in order with respect to $f_1$, the following is obtained.

$$f_1\leqq d_0/\{1+W_0/(D_1-2\delta)\} \quad (11)$$

Since $\delta\geqq 0$ is satisfied in the system having the aperture stop 11 between the first lens L1 and the second lens L2, the following is satisfied.

$$D_1-2\delta\leqq D_1 \quad (12)$$

Therefore, the formula (11) can be modified as follows.

$$f_1\leqq d_0/\{1+W_0/(D_1-2\delta)\}\leqq d_0/(1+W_0/D_1) \quad (13)$$

Therefore, the following formula is also satisfied in the case in which the aperture stop 11 is located closer to the object than the first lens L1, in addition to the in which the aperture stop is located between the first lens L1 and the second lens L2.

$$f_1\leqq d_0/(1+W_0/D_1) \quad (14)$$

Hereinabove, it is assumed that the pair of positive lenses are thin lenses. However, in the case in which the pair of positive lenses are formed of thick lenses, the distance $d_0$ between the light emitter array 1 (the light source) and the first lens L1 is defined as the distance between the light emitter array 1 (the light source) and the first principal point (the front principal point) of the first lens L1.

The formula (14) can cover the case in which the medium between the light emitter array 1 (the light source) and the first lens L1 is not air, or also the case in which a plurality of media formed of parallel plates perpendicular to the optical axis, by defining the do as the total of the values (the reduced thicknesses) obtained by dividing the thicknesses of the respective media by the refractive indexes of the respective media.

Regarding the positional relationship between the aperture stop 11 and the lens system (the microlens) 5, a telecentric arrangement with respect to the image side is preferable. In order to obtain a telecentric configuration with respect to the image side, the aperture stop 11 is disposed at the front focal position of the lens system (the microlens) 5 in the case in which the aperture stop 11 is located on the front side of the first lens L1 (between the first lens L1 and the object) as shown in FIG. 13, or disposed at the front focal point of/the second lens L2 in the case in which the aperture stop 11 is located between the first lens L1 and the second lens L2 as shown in FIG. 14. By arranging the lens system (the microlens) 5 telecentricly with respect to the image side, the positional shift of the imaging spots on the photoconductor 41 corresponding to the light emitting elements 2 of the light emitter blocks 4 is prevented even when the back and forth movement of the surface of the photoconductor (the image plane) 41 as the image plane in the direction of the optical axis O-O' of the lens is caused by the fluctuation of the photoconductor, and the variation (the variation in the imaging spot pitches in the main-scanning direction) in the pitches between the scan lines drawn by the imaging spots moving relatively in the sub-scanning direction can also be prevented from occurring.

In the above explanations, although it is assumed that the each of the positive lenses L1, L2 forming the microlens 5 is formed of a single lens, it is also possible to form each of the positive lenses L1, L2 of a lens system with positive refractive power having two or more lenses disposed coaxially.

Further, in the above explanations, although it is assumed that the microlenses 5 are each formed of an axisymmetric lens system having the focal distances and the focal positions in the main-scanning direction and the sub-scanning direction identical to each other, it is also possible to use the configuration in which the lens system forming the microlens 5 is formed of an anamorphic lens system, and has the focal distances and the magnifications in the main-scanning and sub-scanning directions different from each other. In such a case, it is only required to dispose the aperture stop 11 at the front focal position (in the case of FIG. 13) of the lens system (the microlens) 5 in the main-scanning direction or at the front focal position (in the case of FIG. 14) of the second lens L2 in the main-scanning direction so as to form the image side telecentric configuration in the main-scanning direction (the main-scanning cross-sectional surface).

An optical system of an optical writing line head has been explained above. Also, in a case of an optical reading line head having an optical path reversed, a plurality of light acceptance elements disposed in a row in the main-scanning direction, and a positive lens disposed corresponding to the plurality of light acceptance elements, and for reading an image by back-projecting the image (the array of the reading spots) of the row of the light acceptance elements on the reading surface, assuming that the projection optical system is formed of a pair of positive lenses, the aperture stop is disposed on the image plane side (the light acceptance element side) of the pair of positive lenses or between the pair of positive lenses, and the focal distance of the positive lens on the image plane side out of the pair of positive lenses is $f_1$, an optical reading line head capable of preventing the loss of light intensity and the ghost can similarly be configured by arranging the configuration thereof to satisfy the following conditional formula.

$$f_1 \leqq d_0/(1+W_0/D_1) \tag{15}$$

In the formula, $d_0$ denotes the distance between the light acceptor array and the rear principal surface of the lens group on the image side, $W_0$ denotes the distance between the farthest off-axis light acceptance elements in the light acceptor block, and $D_1$ denotes the effective diameter of the lens group on the image side.

In this case, in FIGS. 13 and 14, the numerical reference 41 denotes the reading surface, the reference numeral 1 denotes the light acceptance surface, and the principle thereof is substantially the same as that of the optical system of the optical writing line head.

An optical writing line head according to an embodiment to which the principle of the invention described above is applied is now explained.

Figure 15:
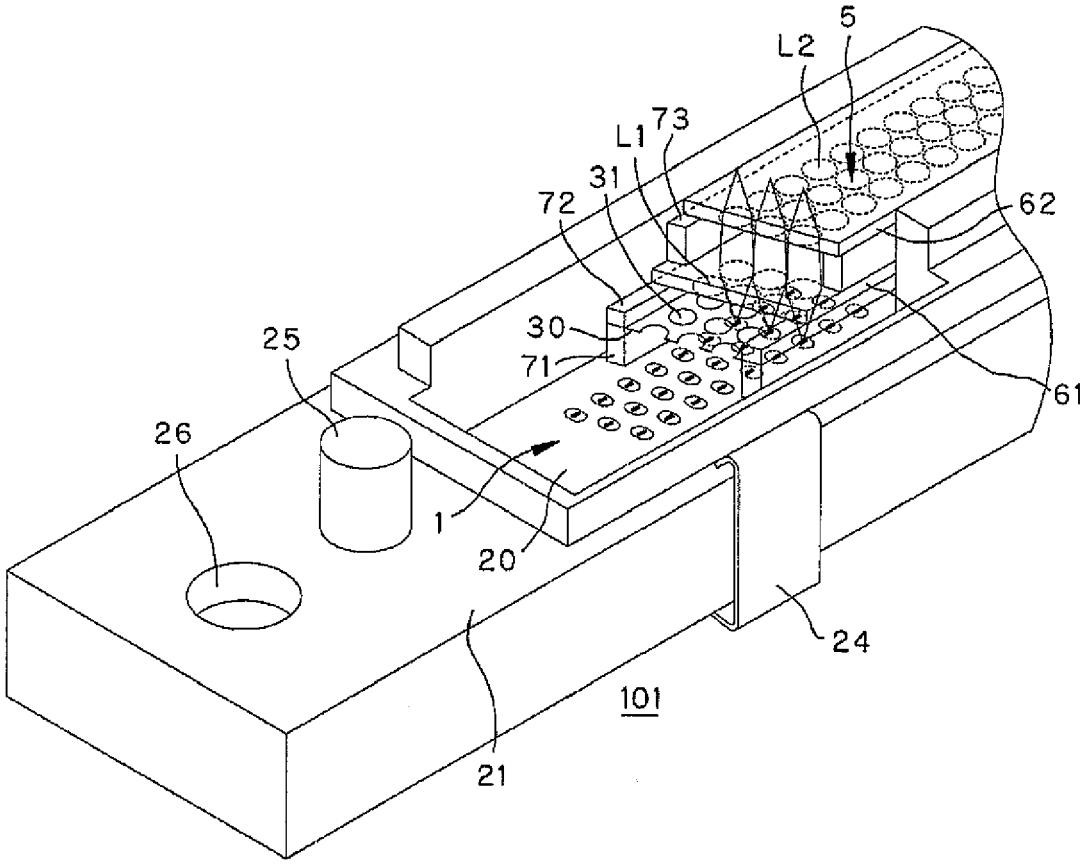
FIG. 15 is a perspective view showing a configuration of an optical writing line head of an embodiment of the invention with a part thereof cut out therefrom.
Figure 16:
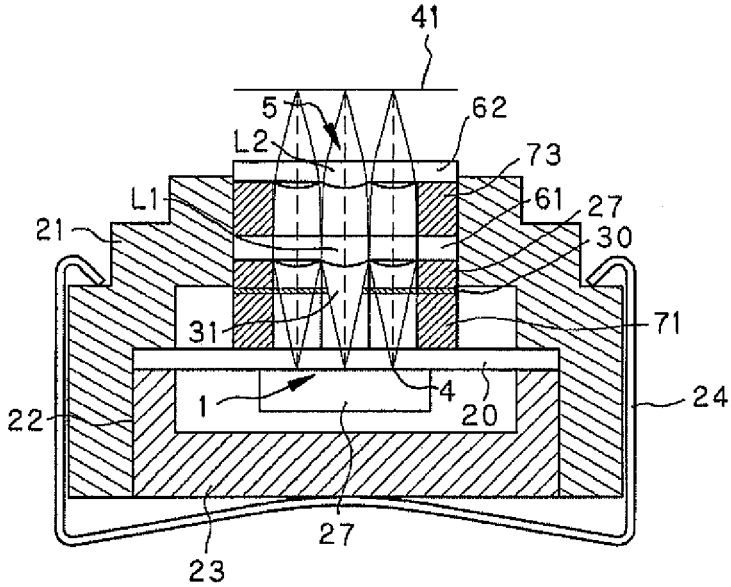
FIG. 16 is a cross-sectional view of the configuration of FIG. 15 along the sub-scanning direction.
Figure 17:
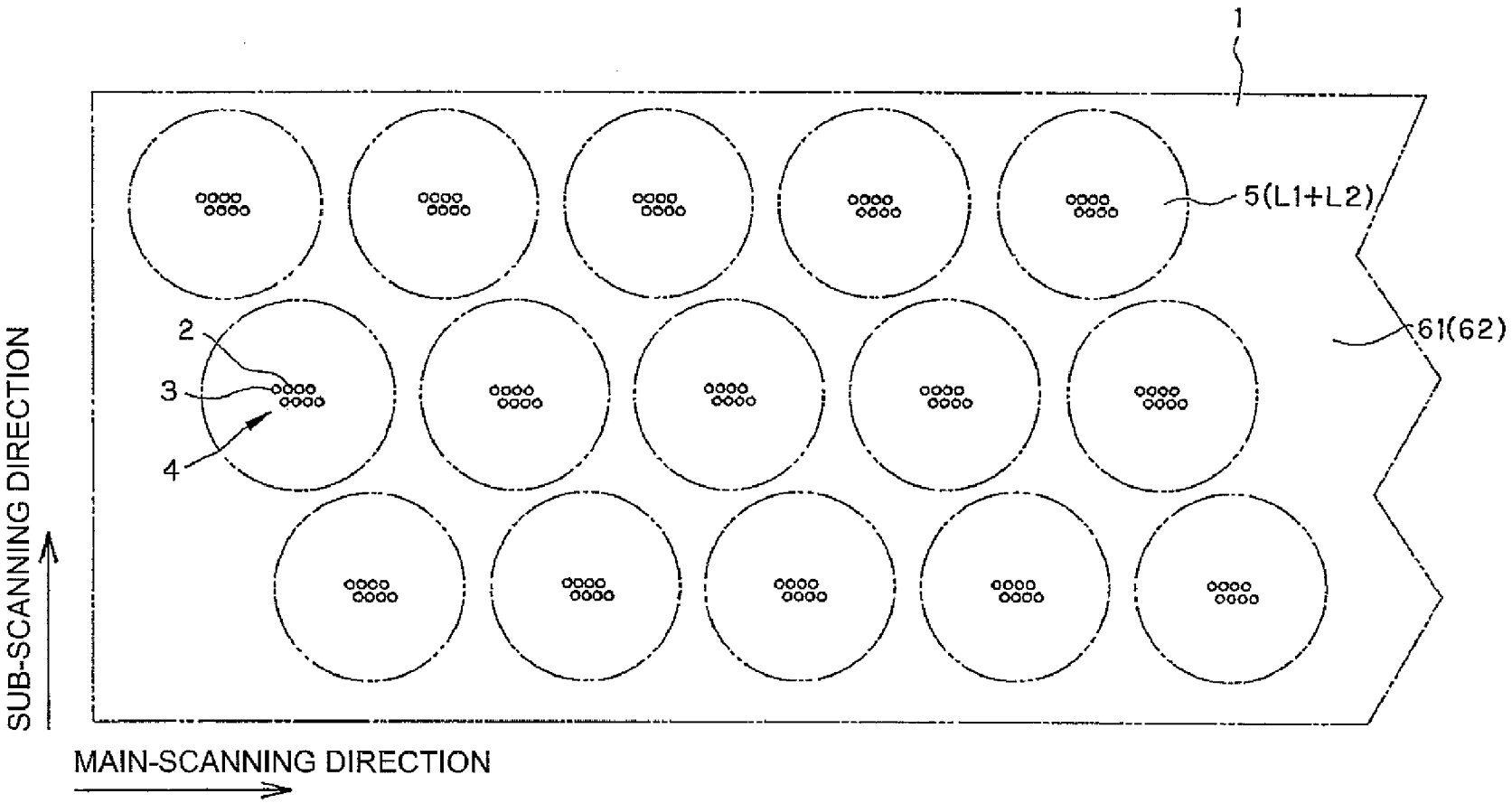
FIG. 17 is a plan view showing an arrangement of the light emitter array and the microlens array in the configuration of FIG. 15.
Figure 18:
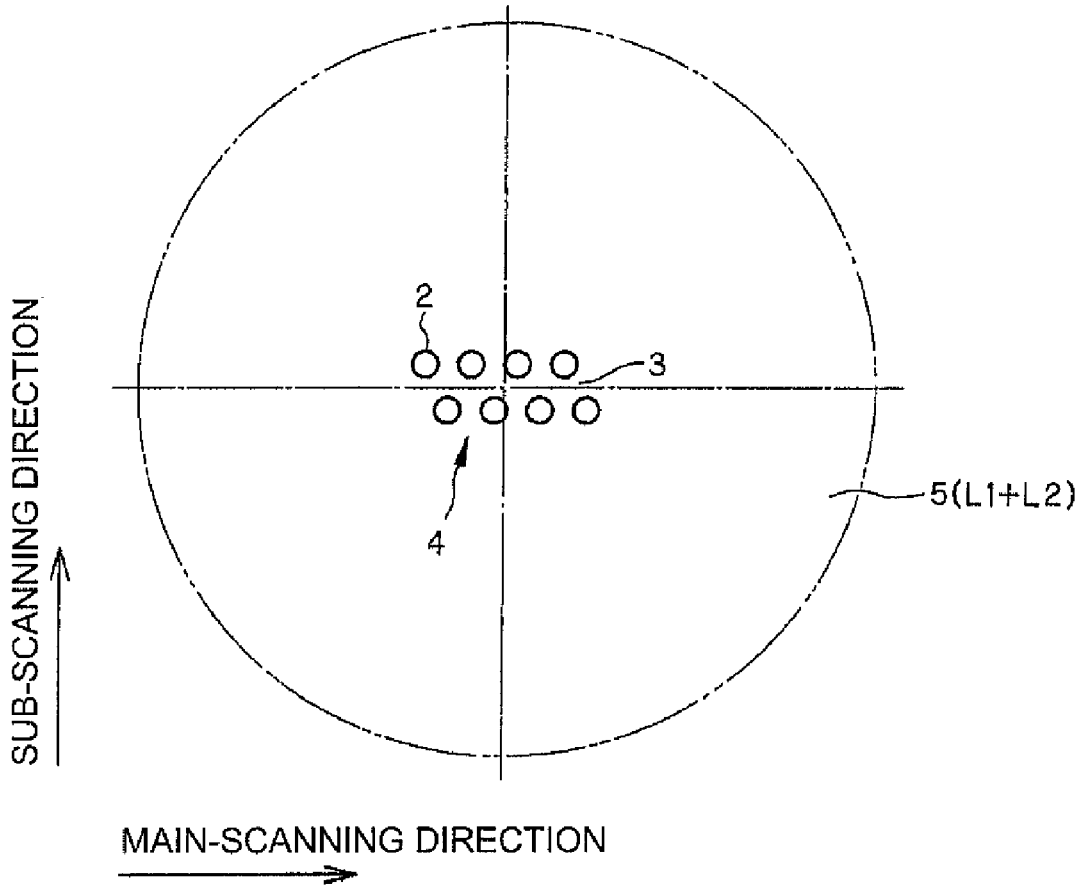
FIG. 18 is a diagram showing a correspondence between each of the microlenses and the light emitter block corresponding thereto.

FIG. 15 shows a configuration of an optical writing line head of an embodiment of the invention with a part thereof cut out therefrom, and FIG. 16 is a cross-sectional view of the configuration along the sub-scanning direction. FIG. 17 is a plan view showing an arrangement of the light emitter array and the microlens array in the present configuration. FIG. 18 is a diagram showing a correspondence between each of the microlenses and the light emitter block corresponding thereto.

In the present embodiment, similarly to the case shown in FIGS. 4 and 7, each of the light emitter blocks 4 is formed of two light emitting element rows 3 arranged in the sub-scanning direction, each having four light emitting elements 2 each formed of an organic EL element arranged in the main-scanning direction. The light emitter array 1 is formed of a plurality of light emitter blocks 4 arranged in both the main-scanning and sub-scanning directions in a zigzag manner with the leading positions in the main-scanning direction shifted from each other between the rows arranged in the sub-scanning direction. In FIG. 15, three rows of the light emitter blocks 4 are arranged in the sub-scanning direction. Such a light emitter array 1 is formed on the back surface of a glass substrate 20, and is driven by a drive circuit formed on the back surface of the same glass substrate 20. The organic EL elements (the light emitting elements 2) on the back surface of the glass substrate 20 are sealed by a sealing member 27.

The glass substrate 20 is fitted into an accepting hole 22 of an elongated case 21, and covered by a rear lid 23 fixed with a fixing bracket 24. Positioning pins 25 provided to both ends of the elongated case 21 are fitted into positioning holes of an image forming device main body opposed to the case 21, and set screws are screwed in and fixed to screw holes of the image forming device main body through screw insertion holes 26 in both ends of the elongated case 21, thereby fixing the optical writing line head 101 to a predetermined position.

An aperture plate 30 provided with apertures 31 (see FIGS. 19 and 20) is disposed via a first spacer 71 on the front surface of the glass substrate 20 of the case 21 so as to be aligned with the centers of the respective light emitter blocks 4 of the light emitter array 1. A first microlens array 61 having the positive lenses L1 as constituents is disposed via a second spacer 72 on the aperture plate 30 so that the centers of the light emitter blocks 4 of the light emitter array 1 and the respective positive lenses L1 are aligned with each other. A second microlens array 62 having the positive lenses L2 as constituents is fixed via a third spacer 73 on the first microlens array 61 so that the centers of the light emitter blocks 4 of the light emitter array 1 and the respective positive lenses L2 are aligned with each other.

As described above, the lens array of the microlenses 5 for projecting the light emitting element rows of the respective light emitter blocks 4 is composed of a combination of the first microlens array 61 and the second microlens array 62.

Figure 19:
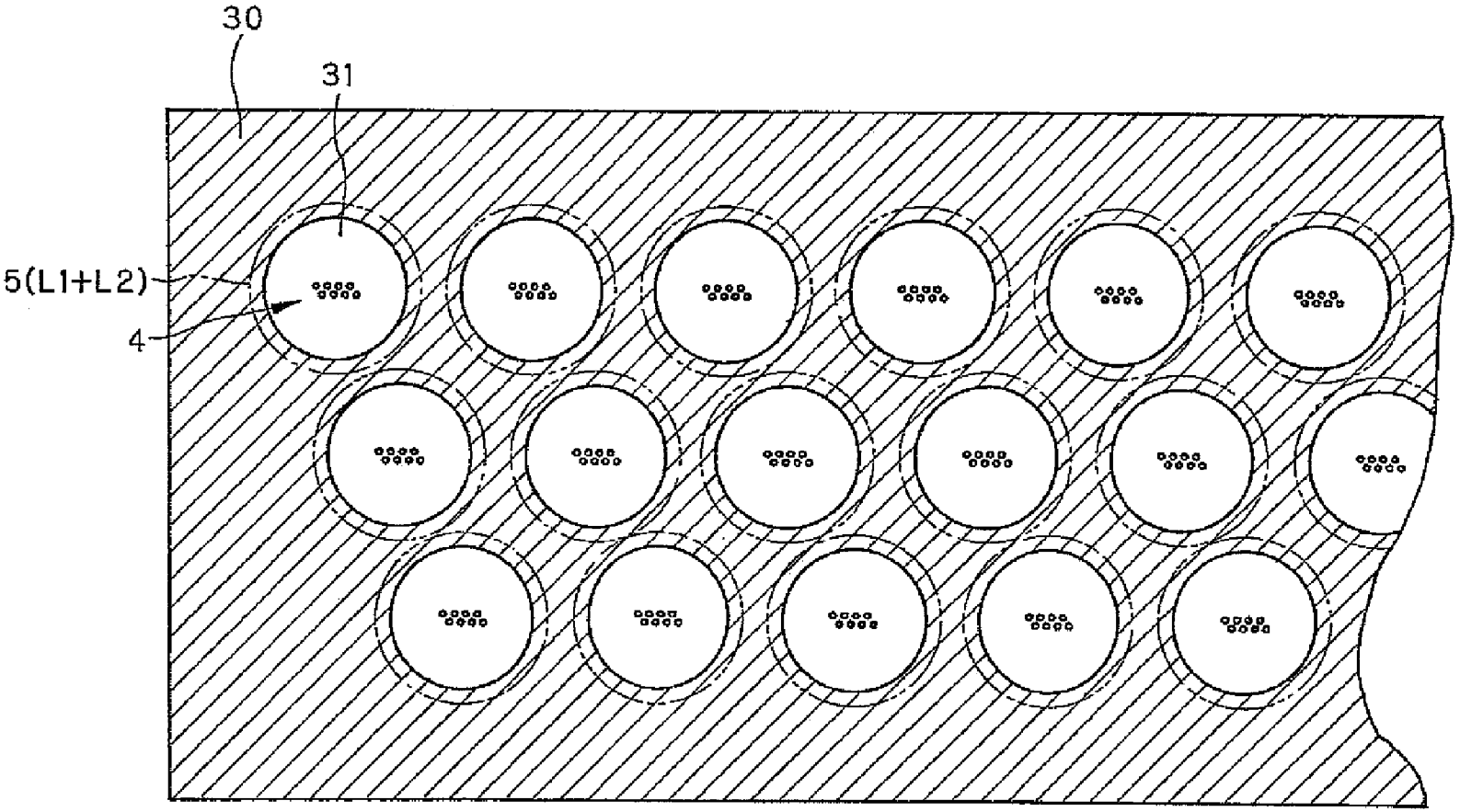
FIG. 19 is a plan view of an aperture plate disposed corresponding to the light emitter blocks of the light emitter array.
Figure 20:
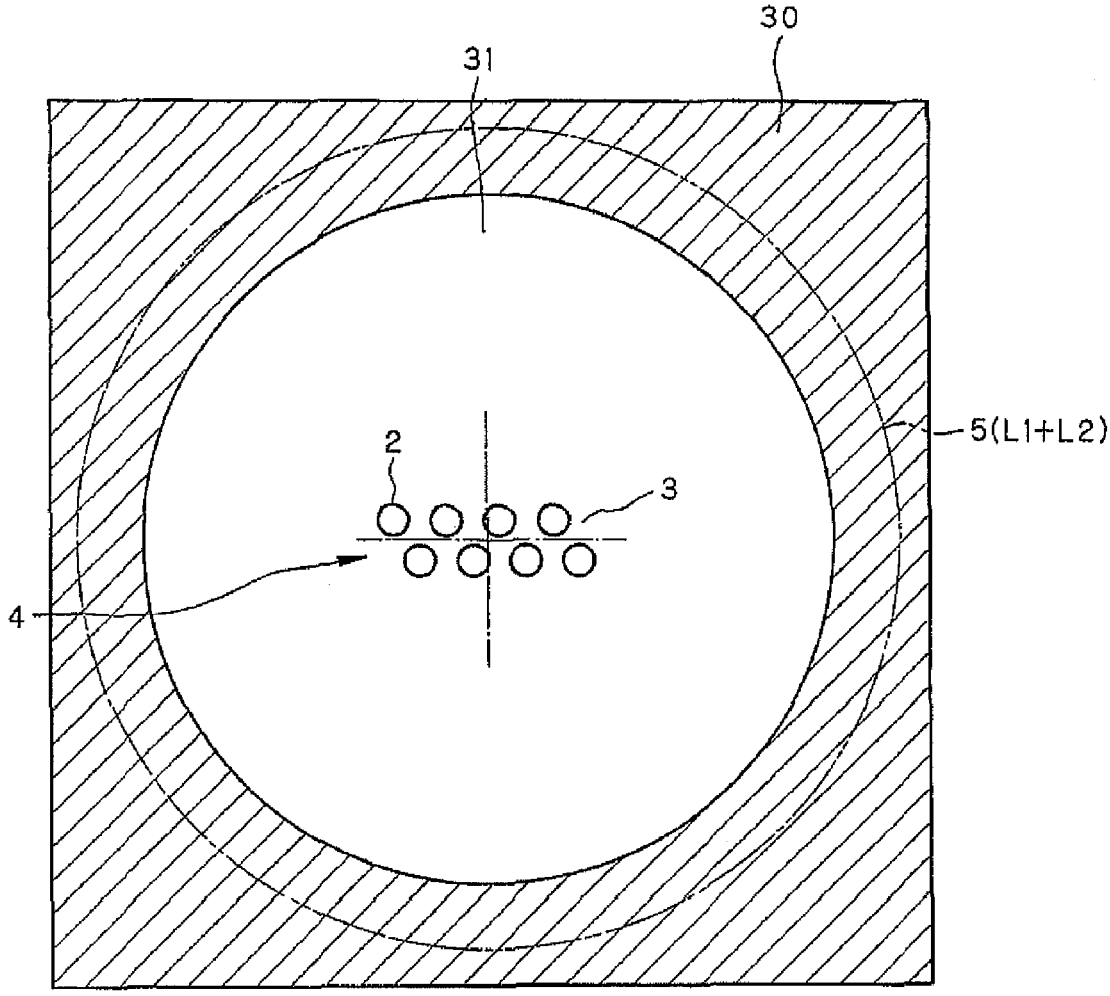
FIG. 20 is a diagram showing an aperture of the aperture plate corresponding to each of the light emitter blocks.

Further, in accordance with the embodiment of the invention, the aperture plate 30 is disposed at the position identical to the object side (the front side) focal position of the combination lens of the positive lens L1 forming the first microlens array 61 and the positive lens L2 forming the second microlens array 62, and the focal distance $f_1$ of the positive lens L1 is determined so as to satisfy the formula (14). The aperture plate 30 is shown in FIGS. 19 and 20 in detail. FIG. 19 is a plan view of the aperture plate 30 disposed corresponding to the light emitter blocks 4 of the light emitter array 1, and FIG. 20 is a diagram showing the aperture 31 of the aperture plate 30 corresponding to each of the light emitter blocks 4. The aperture plate 30 is provided with the apertures 31 aligned with the centers of the respective light emitter blocks 4 and the centers (the optical axes) of the respective microlenses 5 each formed of the positive lens L1 and the positive lens L2. Although the shape of each of the apertures 31 is a circle in the present embodiment, the aperture shape can be an ellipse or a rectangle for limiting the aperture diameter in at least the main-scanning direction.

Although in the present embodiment the optical writing line head 101 has a so-called bottom emission layout in which the organic EL elements provided on the back surface of the glass substrate 20 are used as the light emitting elements 2, and the light emitted from the front surface of the glass substrate 20 is used, it is also possible to use the EL elements or the LEDs having the light emitting elements 2 on the front surface of the substrate.

Figure 21:
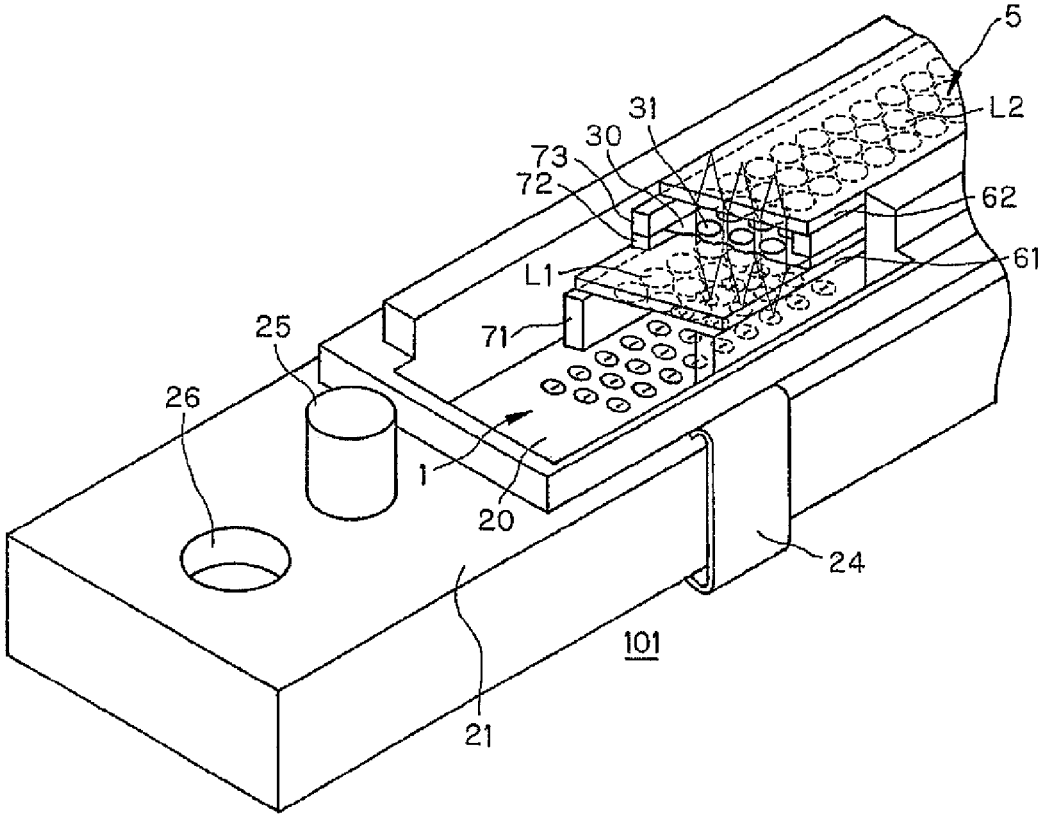
FIG. 21 is a diagram corresponding to FIG. 15, and showing the configuration in the case in which the aperture plate is disposed between a first microlens array and a second microlens array.
Figure 22:
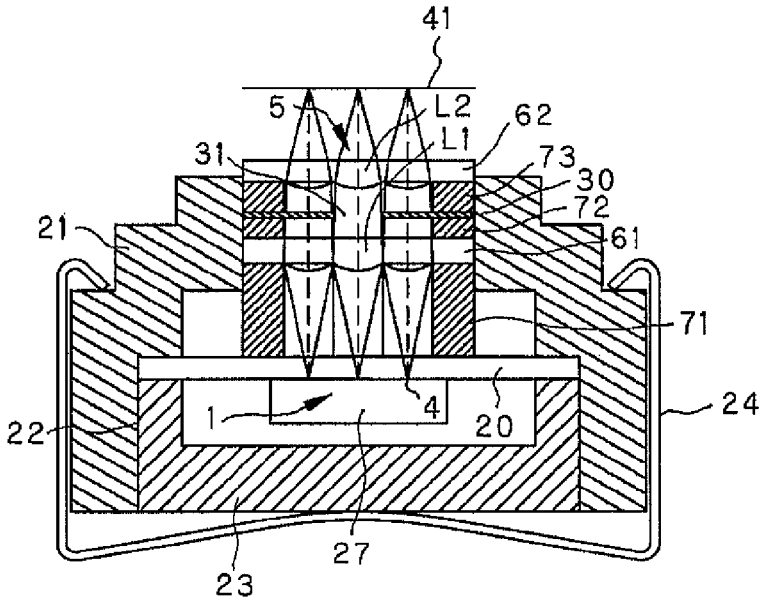
FIG. 22 is a diagram corresponding to FIG. 16, and showing the configuration in the case in which the aperture plate is disposed between the first microlens array and the second microlens array.

FIGS. 21 and 22 show the case in which the aperture plate 30 is disposed between the first microlens array 61 and the second microlens array 62, and correspond to FIGS. 15 and 16. In this case, the first microlens array 61 having the positive lenses L1 as constituents is disposed via the first spacer 71 on the front surface on the glass substrate 20 of the case 21 so that the centers of the light emitter blocks 4 of the light emitter array 1 and the respective positive lenses L1 are aligned with each other. The aperture plate 30 provided with the apertures 31 (FIGS. 19 and 20) is disposed via the second spacer 72 on the first microlens array 61 so as to be aligned with the centers of the respective light emitter blocks 4 of the light emitter array 1. The second microlens array 62 having the positive lenses L2 as constituents is fixed via the third spacer 73 on the aperture plate 30 so that the centers of the light emitter blocks 4 of the light emitter array 1 and the respective positive lenses L2 are aligned with each other. The other parts of the configuration are the same as in FIGS. 15 and 16, and explanations therefor are omitted. Further, in accordance with the invention, the focal distance $f_1$ of the positive lens L1 is determined so as to satisfy the formula (14).

Figure 23:
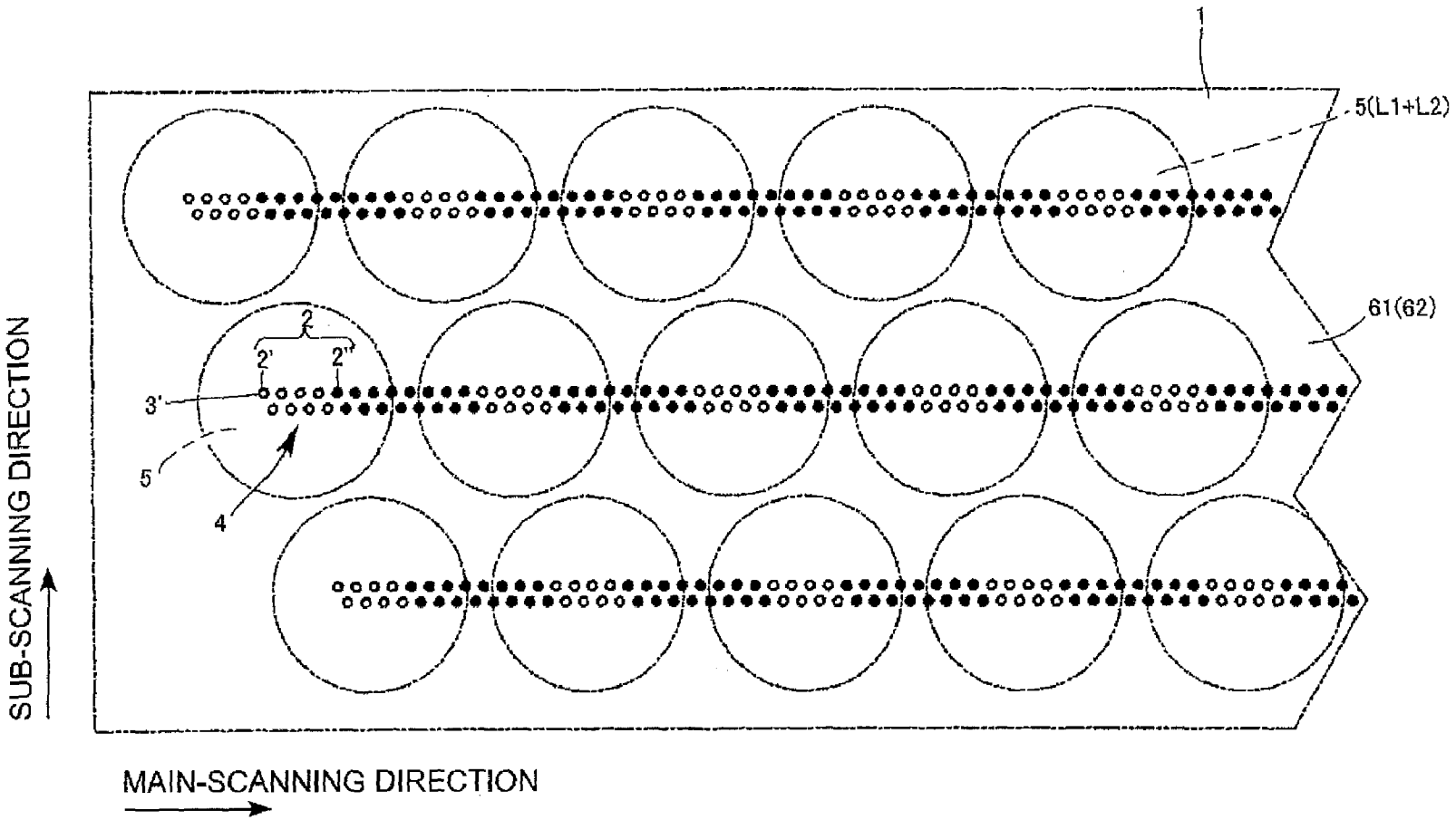
FIG. 23 is a diagram corresponding to FIG. 17, and showing the configuration in the case in which the light emitter blocks are formed by arranging the light emitting elements in rows elongated in the main-scanning direction, and executing emission control on some of the light emitting elements.

In the above explanations, it is assumed that the light emitter array 1 has the light emitter blocks 4 each formed of one or more light emitting element rows 3 arranged in the sub-scanning direction each having a plurality of light emitting elements 2 arranged in the main-scanning direction, and the microlenses 5 are disposed to correspond respectively to the light emitter blocks 4 as shown in FIGS. 7 and 17. However, the light emitting elements 2 are arranged in long rows continuing in the main-scanning direction at fine intervals, only the light emitting element groups corresponding respectively to the light emitter blocks 4 are controlled to emit light, and the light emitting elements disposed between the light emitting element groups are controlled not to emit light, thereby making it possible to configure the light emitter blocks 4 similar to the case of FIGS. 7 and 17. FIG. 23 shows a diagram of such a case and corresponds to FIG. 17. In other words, the light emitting elements 2 are arranged as the light emitting element rows 3' each having the light emitting elements 2 continuing in a long row at fine even intervals in the main-scanning direction, the light emission control is executed only on groups of the light emitting elements 2' (illustrated with ○ (open circles)) to be involved in the formation of the imaging spots 8 through the microlenses 5 out of the all light emitting elements 2, and groups of the light emitting elements 2" (illustrated with ● (filled circles)) disposed between the groups of light emitting elements 2' are controlled not to emit light, thereby making it possible to configure the light emitter blocks 4 in the light emitter array 1. In FIG. 23, the microlenses 5 are arranged in three rows in the main-scanning direction, two light emitting element rows 3' are formed in the sub-scanning direction to correspond to each of the rows of the microlenses 5, and to form a zigzag arrangement, and the light emitting elements 2 are controlled so that groups each including four light emitting elements 2' corresponding to respective one of the microlenses 5 in the light emitting element rows 3' are only allowed to emit light, and the eight light emitting elements 2" between the groups are not allowed to emit light.

In the above explanations, it is assumed that in the case in which all of the light emitting elements 2 (2' in FIG. 23) in all of the light emitter blocks 4 are lighted with the adjusted timing for drawing a line extending in the main-scanning direction, the imaging spots 8 on the image holding member 41 are aligned adjacent to each other in just proportion between the light emitter blocks 4. However, it is also possible to arrange the number and the positions of the light emitting elements 2 (2' in the case shown in FIG. 23) forming each of the light emitter blocks 4 to have redundancy so that the imaging spots 8 corresponding to the light emitting elements 2 (2') forming the light emitter blocks 4 overlap with each other on the image holding member 41. According to the arrangement described above, even if a concentration variation occurs in the imaging spots 8 as the images of the light emitting elements 2 (2') in the vicinity of the end section of the light emitter block 4, for example, the variation can be corrected by overlapping the spots 8 with each other.

Figure 24:
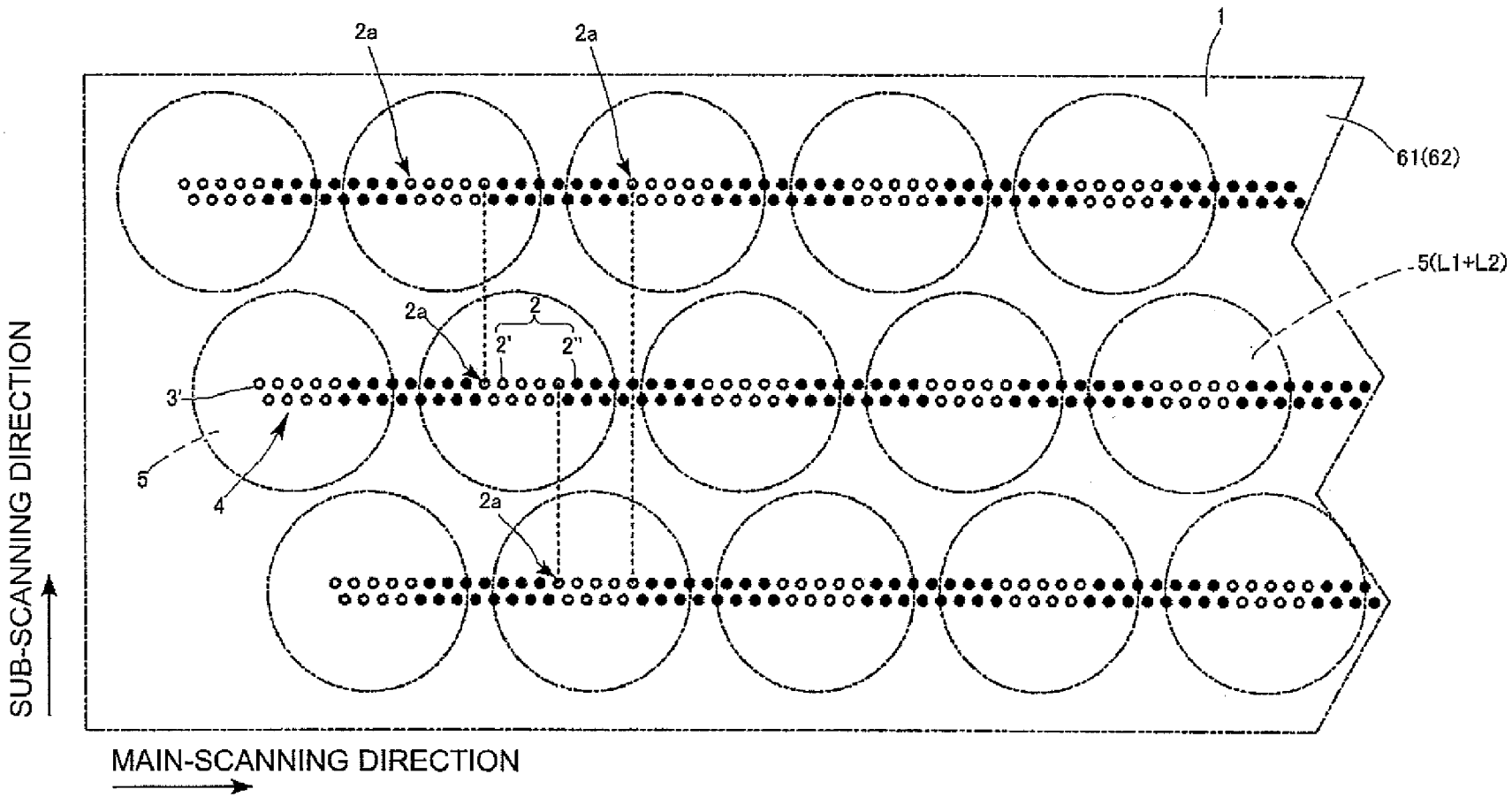
FIG. 24 is a diagram showing an example in which the number of light emitting elements forming the light emitter block is increased so that the rows of the imaging spots of the light emitter blocks adjacent to each other on the image holding member are exposed overlapping at the ends of the rows.

FIG. 24 shows an example of the configuration described above in which the light emitter array 1 has the configuration shown in FIG. 23, and one light emitting element 2*a* is added to the 4×2 light emitting elements 2' forming each of the light emitter blocks 4, such that the rows of the imaging spots 8 arranged on the image holding member 41 by the adjacent microlenses 5 overlap in one imaging spot 8 at the end of each of the rows of the imaging spots 8 to be exposed. Although FIG. 24 shows the condition in which the light emitting element 2*a* overlaps the opposite end of the adjacent light emitter block 4 on the light emitter array 1 side (the light emitting elements connected with the dotted line), the drawing is correct only in the case in which the imaging magnification of the microlens 5 is equal to −1.

Figure 25:
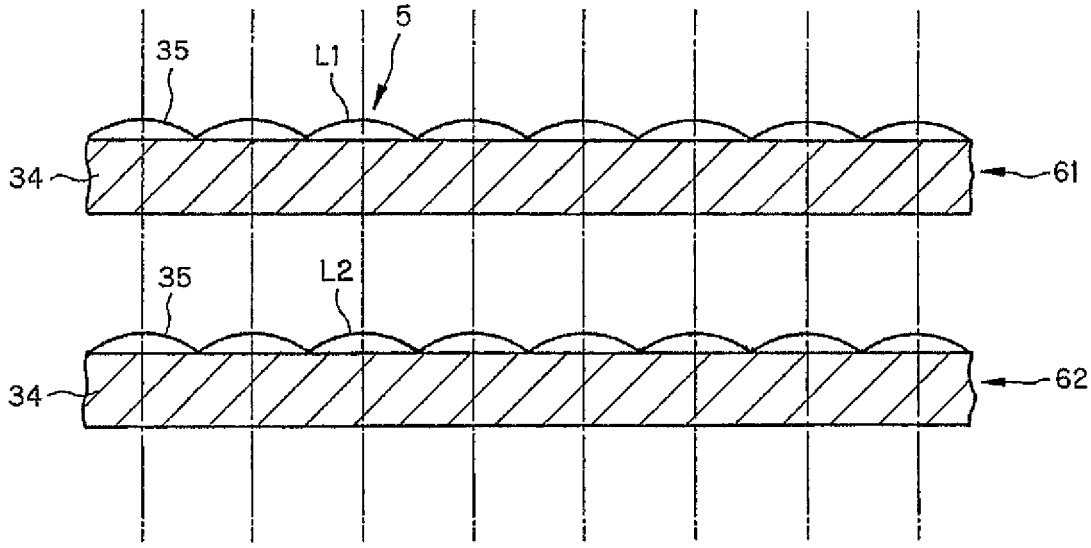
FIG. 25 is a cross-sectional view of the microlens array along the main-scanning direction in the case in which the microlens array is composed of two microlens arrays

Microlens array 61, 62 having any known configurations can be used for the optical writing line head 101. FIG. 25 is a cross-sectional view of an array of the microlenses 5 along the main-scanning direction in the case (see FIGS. 13 and 14) in which the array is configured by combining the first microlens array 61 and the second microlens array 62 so that the microlenses L1 and the microlenses L2 are respectively aligned coaxially. In this example, the microlenses L1, L2 are configured by integrally molding the lens surfaces 35 made of transparent resin aligned on one surface (the object side) of each of the glass substrates 34 of the microlens arrays 61, 62. In this case, by forming the image side surface of the second microlens array 62 as a flat surface, in the case of being used as a microlens array of the line head of, for example, the image forming device, if the toner of the developer is scattered and attached to the flat surface of the microlens array, the toner can easily be removed, thus the cleanability is enhanced.

Specific numerical examples of the optical systems used for the embodiments described above are now described as specific examples 1 through 4.

Figure 26A:
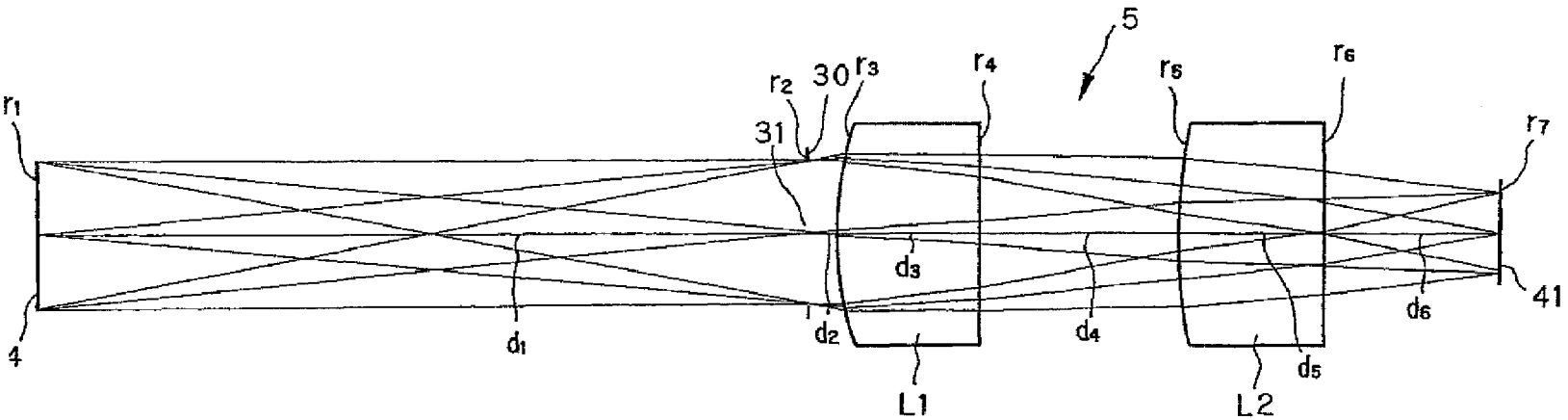
FIGS. 26A and 26B are cross-sectional views of an optical system corresponding to each of the microlenses of a specific example 1 in the main-scanning direction and the sub-scanning direction, respectively.
Figure 26B:
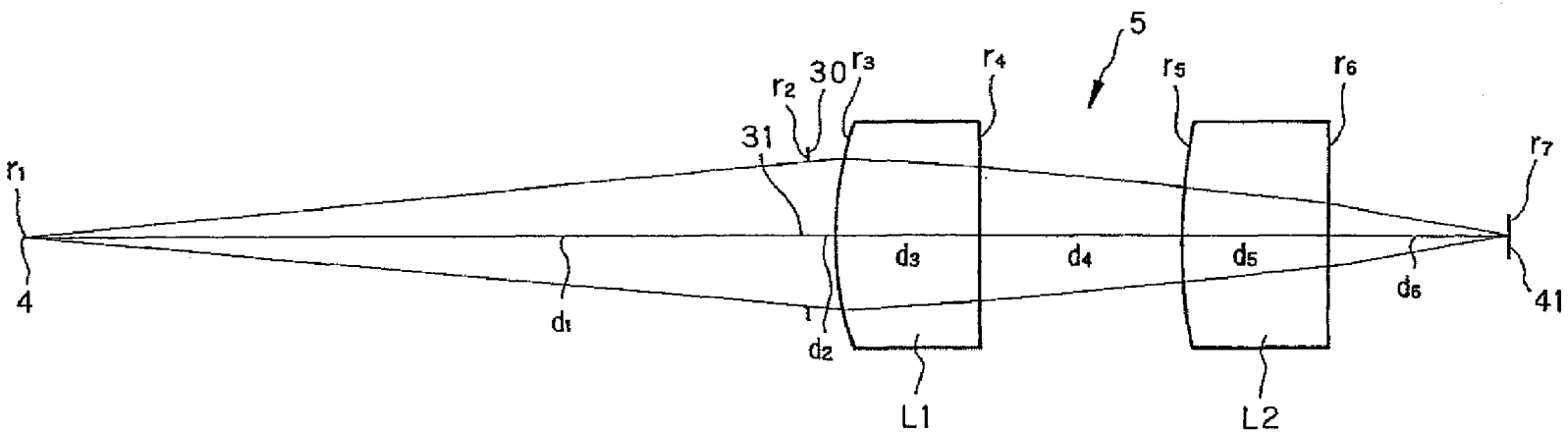

FIGS. 26A and 26B are cross-sectional views of the optical system corresponding to each of the microlenses 5 of the specific example 1 in the main-scanning direction and the sub-scanning direction, respectively. In example 1, the glass substrate is not disposed on the emission side of the light emitting elements 2, each of the microlenses 5 is formed as a combination lens system composed of a plano-convex positive lens L1 and a plano-convex positive lens L2, the aperture plate 30 is disposed on the object side (the front side) of the combination lens system composed of the plano-convex positive lens L1 and the plano-convex positive lens L2, and the focal distance $f_1$ of the plano-convex positive lens L1 is determined so as to satisfy the formula (14) The specific example 1 does not have the telecentric configuration with respect to the image side.

By forming both the first positive lens L1 and the second positive lens L2 as plano-convex positive lenses in the specific example 1, the lens formation surface that is formed as the microlens arrays 61, 62 is limited to one of the sides. Thus, an advantage that the microlens arrays is easily manufactured is obtained.

By forming the image side surface of the second positive lens L2 as a flat surface, the entire image side surface of the second microlens array 62 forming the lens array of the microlenses 5 can be made as a flat surface, in the case of being used as a microlens array of the line head of, for example, the image forming device, if the toner of the developer is scattered and attached to the flat surface of the microlens array, the toner can easily be removed, thus cleanability is enhanced.

The numerical data according to specific example 1 is shown below, wherein the symbols in the order from the light emitter block 4 side to the photoconductor (the image plane) 41 side denote as follows: $r_1$, $r_2$, . . . denote curvature radii (mm) of respective optical surfaces; $d_1$, $d_2$, . . . denote distances (mm) between the respective optical surfaces; $n_{d1}$, $n_{d2}$, . . . denote refractive indexes of the respective transparent media on the d line; and $v_{d1}$, $v_{d2}$, . . . denote the Abbe numbers of the respective transparent media. Symbols $r_1$, $r_2$, . . . denote optical surfaces. The optical surface $r_1$ is the light emitter block 4 (the object plane), the optical surface $r_2$ is the aperture 31 of the aperture plate 30, the optical surfaces $r_3$, $r_4$ are the object side surface and the image side surface of the plano-convex positive lens L1, the optical surfaces $r_5$, $r_6$ are the object side surface and the image side surface of the plano-convex positive lens L2, and the optical surface $r_7$ is the photoconductor 41 (the image plane).

Figure 27A:
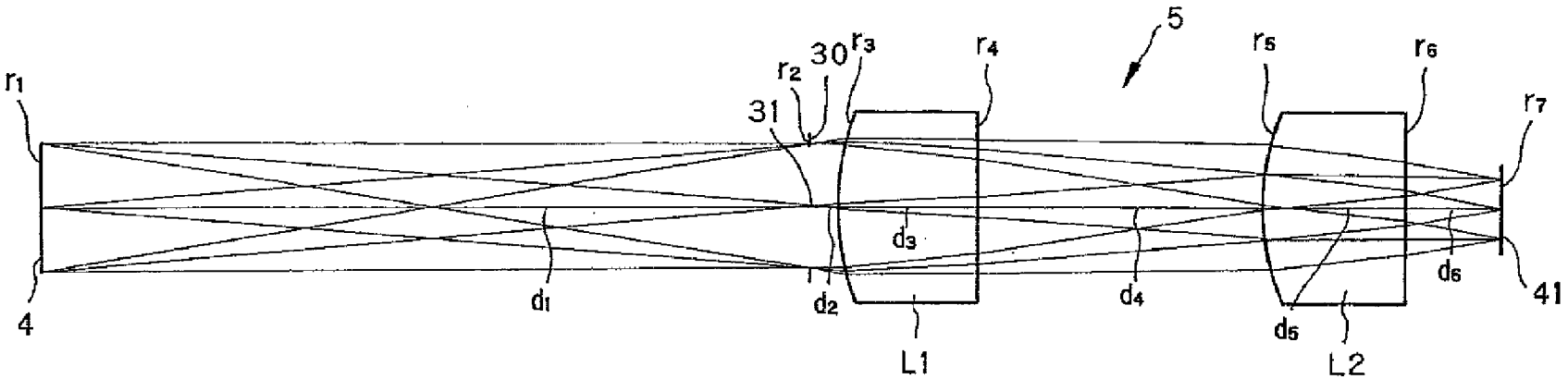
FIGS. 27A and 27B are cross-sectional views of an optical system corresponding to each of the microlenses of a specific example 2 in the main-scanning direction and the sub-scanning direction, respectively.
Figure 27B:
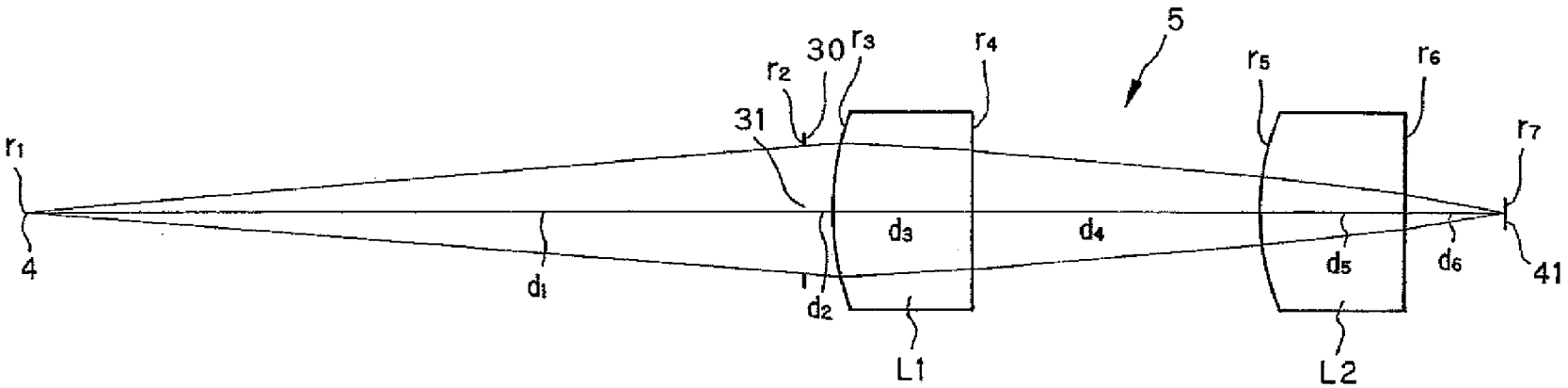

FIGS. 27A and 27B are cross-sectional views of the optical system corresponding to each of the microlenses 5 of the specific example 2 in the main-scanning direction and the sub-scanning direction, respectively. In example 2, the glass substrate is not disposed on the emission side of the light emitting elements 2, each of the microlenses 5 is formed as a combination lens system composed of a plano-convex positive lens L1 and a plano-convex positive lens L2, the aperture plate 30 is disposed at the focal position on the object side (the front side) of the combination lens system composed of the plano-convex positive lens L1 and the plano-convex positive lens L2 to form a telecentric arrangement with respect to the image side, and the focal distance $f_1$ of the plano-convex positive lens L1 is determined so as to satisfy the formula (14).

Also in the specific example 2, both the first positive lens L1 and the second positive lens L2 are formed as plano-convex positive lenses.

The numerical data according to specific example 2 is shown below, wherein the symbols in the order from the light emitter block 4 side to the photoconductor (the image plane) 41 side denote as follows: $r_1$, $r_2$, . . . denote curvature radii (mm) of respective optical surfaces; $d_1$, $d_2$, . . . denote distances (mm) between the respective optical surfaces; $n_{d1}$, $n_{d2}$, . . . denote refractive indexes of the respective transparent media on the d line; and $v_{d1}$, $v_{d2}$, . . . denote the Abbe numbers of the respective transparent media. Symbols $r_1$, $r_2$, . . . denote optical surfaces. The optical surface $r_1$ is the light emitter block 4 (the object plane), the optical surface $r_2$ is the aperture 31 of the aperture plate 30, the optical surfaces $r_3$, $r_4$ are the object side surface and the image side surface of the plano-convex positive lens L1, the optical surfaces $r_5$, $r_6$ are the object side surface and the image side surface of the plano-convex positive lens L2, and the optical surface $r_7$ is the photoconductor 41 (the image plane).

Figure 28A:
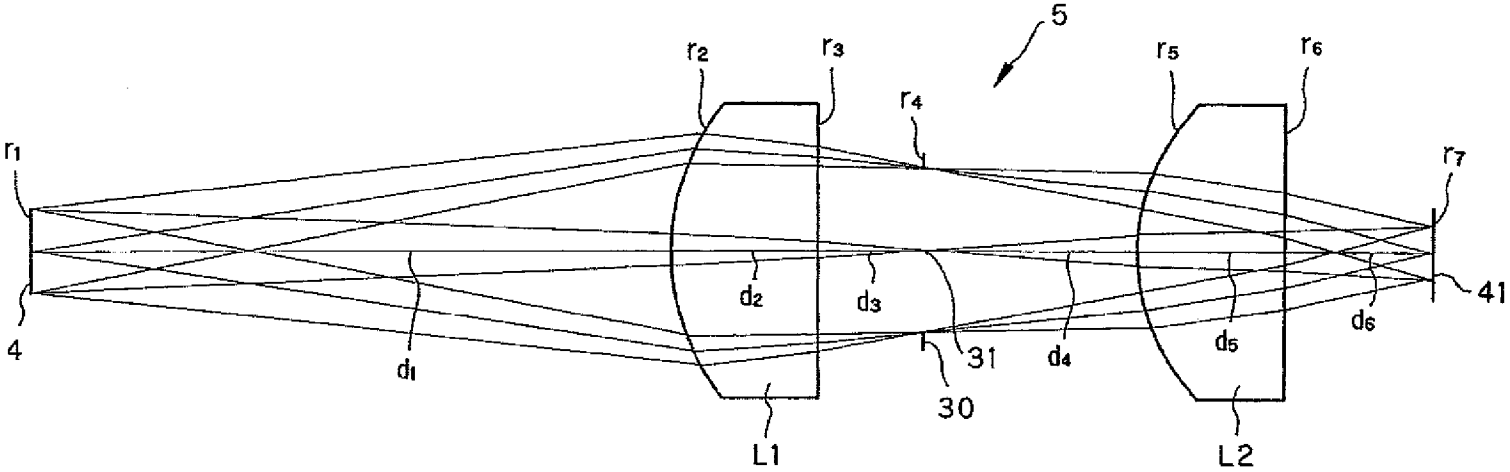
FIGS. 28A and 28B are cross-sectional views of an optical system corresponding to each of the microlenses of a specific example 3 in the main-scanning direction and the sub-scanning direction, respectively.
Figure 28B:
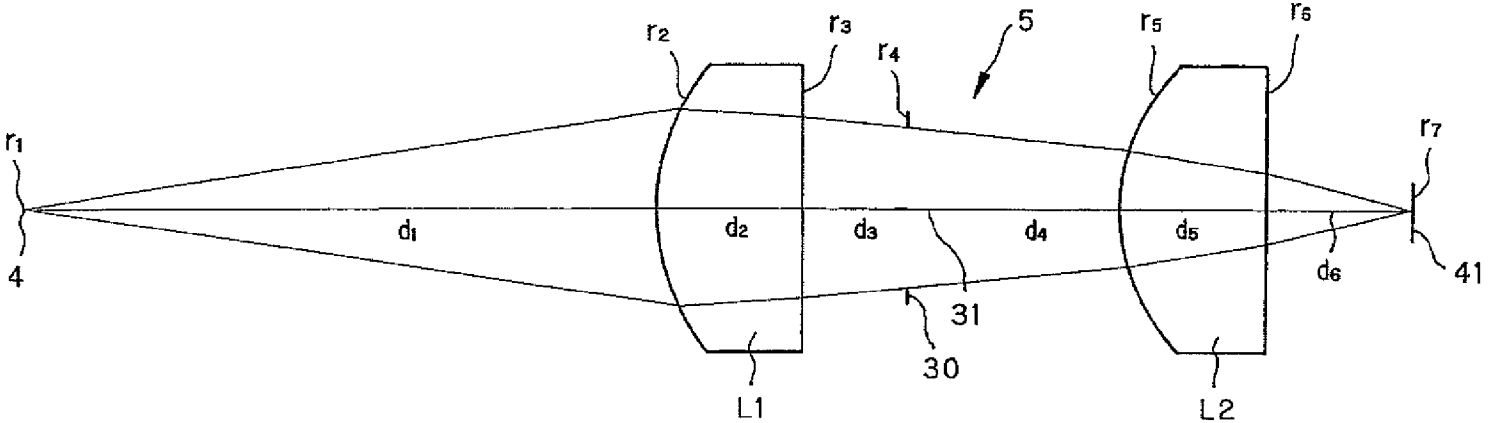

FIGS. 28A and 28B are cross-sectional views of the optical system corresponding to each of the microlenses 5 of the specific example 3 in the main-scanning and sub-scanning directions, respectively. In example 3, the glass substrate is not disposed on the emission side of the light emitting elements 2, each of the microlenses 5 is formed as a combination lens system composed of a plano-convex positive lens L1 and a plano-convex positive lens L2, the aperture plate 30 is disposed between the plano-convex positive lens L1 and the plano-convex positive lens L2 in the combination lens system, and the focal distance $f_1$ of the plano-convex positive lens L1 is determined so as to satisfy the formula (14). The specific example 3 does not have the telecentric configuration with respect to the image side.

Also, in the specific example 3, both the first positive lens L1 and the second positive lens L2 are formed as plano-convex positive lenses.

The numerical data according to specific example 3 is shown below, wherein the symbols in the order from the light emitter block 4 side to the photoconductor (the image plane) 41 side denote as follows: $r_1$, $r_2$, . . . denote curvature radii (mm) of respective optical surfaces; $d_1$, $d_2$, . . . denote distances (mm) between the respective optical surfaces; $n_{d1}$, $n_{d2}$, . . . denote refractive indexes of the respective transparent media on the d line; and $v_{d1}$, $v_{d2}$, . . . denote the Abbe numbers of the respective transparent media. Symbols $r_1$, $r_2$ . . . denote optical surfaces. The optical surface $r_1$ is the light emitter block 4 (the object plane), the optical surfaces $r_2$, $r_3$ are the object side surface and the image side surface of the plano-convex positive lens L1, the optical surface $r_4$ is the aperture 31 of the aperture plate 30, the optical surfaces $r_5$, $r_6$ are the object side surface and the image side surface of the plano-convex positive lens L2, and the optical surface $r_7$ is the photoconductor 41 (the image plane).

Figure 29A:
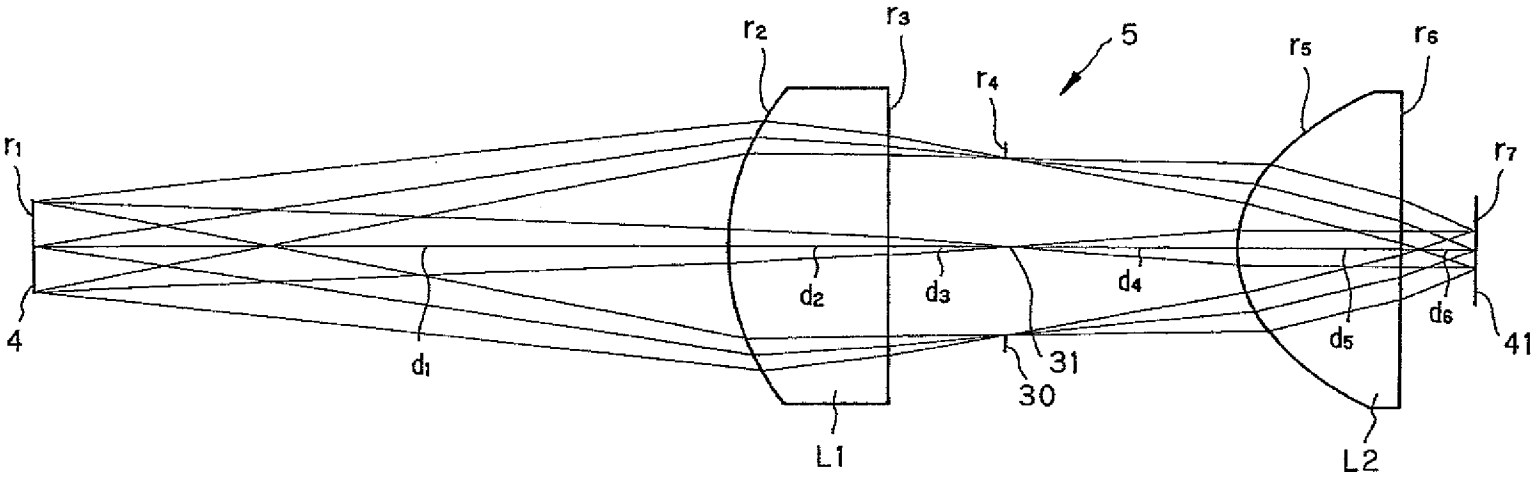
FIGS. 29A and 29B are cross-sectional views of an optical system corresponding to each of the microlenses of a specific example 4 in the main-scanning direction and the sub-scanning direction, respectively.
Figure 29B:
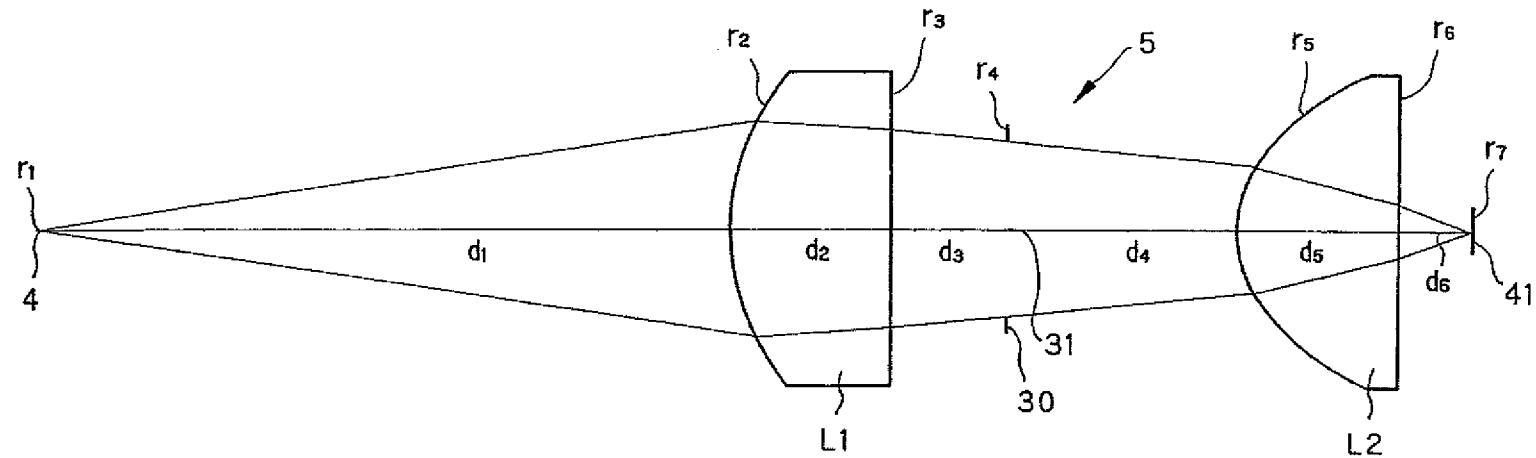

FIGS. 29A and 29B are cross-sectional views of the optical system corresponding to each of the microlenses 5 of the specific example 4 in the main-scanning and sub-scanning directions, respectively. In example 4, the glass substrate is not disposed on the emission side of the light emitting elements 2, each of the microlenses 5 is formed as a combination lens system composed of a plano-convex positive lens L1 and a plano-convex positive lens L2, the aperture plate 30 is disposed at the focal position on the object side (the front side) of the plano-convex positive lens L2 between the plano-convex positive lens L1 and the plano-convex positive lens L2 of the combination lens system to form a telecentric arrangement with respect to the image side, and the focal distance $f_1$ of the plano-convex positive lens L1 is determined so as to satisfy the formula (14).

Also in the specific example 4, both the first positive lens L1 and the second positive lens L2 are formed as plano-convex positive lenses.

The numerical data according to the specific example 4 is shown below, wherein the symbols in the order from the light emitter block 4 side to the photoconductor (the image plane) 41 side denote as follows: $r_1$, $r_2$, . . . denote curvature radii (mm) of respective optical surfaces; $d_1$, $d_2$, . . . denote distances (mm) between the respective optical surfaces; $n_{d1}$, $n_{d2}$, . . . denote refractive indexes of the respective transparent media on the d line; and $v_{d1}$, $v_{d2}$, . . . denote the Abbe numbers of the respective transparent media. Symbols $r_1$, $r_2$, . . . denote optical surfaces. The optical surface $r_1$ is the light emitter block 4 (the object plane), the optical surfaces $r_2$, $r_3$ are the object side surface and the image side surface of the plano-convex positive lens L1, the optical surface $r_4$ is the aperture 31 of the aperture plate 30, the optical surfaces $r_5$, $r_6$ are the object side surface and the image side surface of the plano-convex positive lens L2, and the optical surface $r_7$ is the photoconductor 41 (the image plane). The object side surface $r_5$ of the plano-convex positive lens L2 is an aspheric surface represented as follows, defining the distance from the optical axis as r.

$$cr^2/[1+\sqrt{\{1-(1+K)c^2r^2\}}]+Ar^4$$

In this formula, c denotes an on-axis curvature (1/r), K denotes a conic constant, and A denotes a fourth-order aspherical coefficient. In the following numerical data, $K_5$ and $A_5$ are, respectively, the conic constant and the fourth-order aspherical coefficient of the object side surface $r_5$ of the plano-convex positive lens L2.

SPECIFIC EXAMPLE 1

$r_1=\infty$ (object plane), $d_1=2.7013$, $r_2=\infty$ (aperture), $d_2=0.1000$, $r_3=0.7420$, $d_3=0.5000$, $n_{d1}=1.5168$, $v_{d1}=64.2$, $r_4=\infty$, $d_4=0.7000$, $r_5=1.2000$, $d_5=0.5000$, $n_{d2}=1.5168$, $v_{d2}=64.2$, $r_6=\infty$, $d_6=0.6200$, $r_7=\infty$ (image plane)

service wavelength: 632.5 nm optical magnification: −0.45 distance between the most off-axis light emitting elements in the light emitter block: $W_0=0.4$ mm aperture diameter: 0.386 mm effective diameter of the first lens: $D_1=0.424$ mm focal distance of the first lens: $f_1=1.440$ mm distance between the object (the light emitter array) and the front principal surface of the first lens: $d_0=2.8013$ mm $$d_0/(1+W_0/D_1)=1.441 \text{ mm}$$

SPECIFIC EXAMPLE 2

$r_1=\infty$ (object plane), $d_1=2.7013$, $r_2=\infty$ (aperture), $d_2=0.1000$, $r_3=0.7420$, $d_3=0.5000$, $n_{d1}=1.5168$, $v_{d1}=64.2$, $r_4=\infty$, $d_4=1.0000$, $r_5=0.7000$, $d_5=0.5000$, $n_{d2}=1.5168$, $v_{d2}=64.2$, $r_6=\infty$, $d_6=0.3500$, $r_7=\infty$ (image plane)

service wavelength: 632.5 nm optical magnification: −0.49 distance between the most off-axis light emitting elements in the light emitter block: $W_0=0.4$ mm aperture diameter: 0.386 mm effective diameter of the first lens: $D_1=0.424$ mm focal distance of the first lens: $f_1=1.440$ mm distance between the object (the light emitter array) and the front principal surface of the first lens: $d_0=2.8013$ mm $$d_0/(1+W_0/D_1)=1.441 \text{ mm}$$

SPECIFIC EXAMPLE 3

$r_1=\infty$ (object plane), $d_1=3.0000$, $r_2=1.1000$, $d_2=0.7000$, $n_{d1}=1.5168$, $v_{d1}=64.2$, $r_3=\infty$, $d_3=0.5000$, $r_4=\infty$ (aperture), $d_4=1.0000$, $r_5=1.0000$, $d_5=0.7000$, $n_{d2}=1.5168$, $v_{d2}=64.2$, $r_6=\infty$, $d_6=0.7000$, $r_7=\infty$ (image plane)

service wavelength: 632.5 nm optical magnification: −0.61 distance between the most off-axis light emitting elements in the light emitter block: $W_0=0.4$ mm aperture diameter: 0.39 mm effective diameter of the first lens: $D_1=1.1033$ mm focal distance of the first lens: $f_1=2.1355$ mm distance between the object (the light emitter array) and the front principal surface of the first lens: $d_0=3.0$ mm $$d_0/(1+W_0/D_1)=2.2017 \text{ mm}$$

SPECIFIC EXAMPLE 4

$r_1=\infty$ (object plane), $d_1=3.0000$, $r_2=1.1000$, $d_2=0.7000$, $n_{d1}=1.5168$, $v_{d1}=64.2$, $r_3=\infty$, $d_3=0.5000$, $r_4=\infty$ (aperture), $d_4=1.0000$, $r_5=0.52210$ (aspheric surface), $d_5=0.7000$, $n_{d2}=1.5168$, $v_{d2}=64.2$, $K_5=-1.4409$, $A_5=0.7397$, $r_6=\infty$, $d_6=0.3500$, $r_7=\infty$ (image plane)

service wavelength: 632.5 nm optical magnification: −0.384 distance between the most off-axis light emitting elements in the light emitter block: $W_0=0.4$ mm aperture diameter: 0.39 mm effective diameter of the first lens: $D_1=1.1033$ mm focal distance of the first lens: $f_1=2.1355$ mm distance between the object (the light emitter array) and the front principal surface of the first lens: $d_0=3.0$ mm $$d_0/(1+W_0/D_1)=2.2017 \text{ mm}$$

Figure 30:
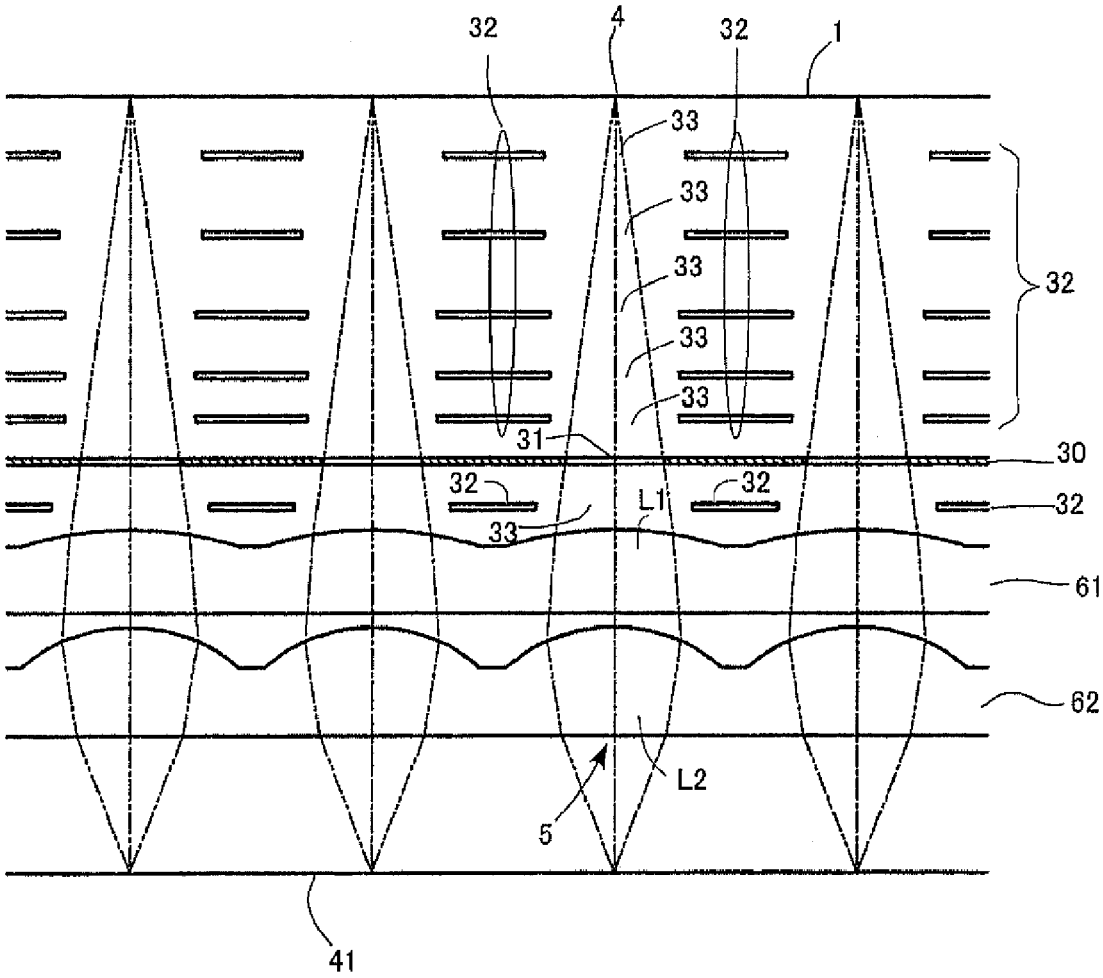
FIG. 30 is a cross-sectional view along the main-scanning direction showing an example of the optical system of the optical writing line head according to an embodiment of the invention provided with an anti-flare aperture plate in addition to the aperture plate.
Figure 31:
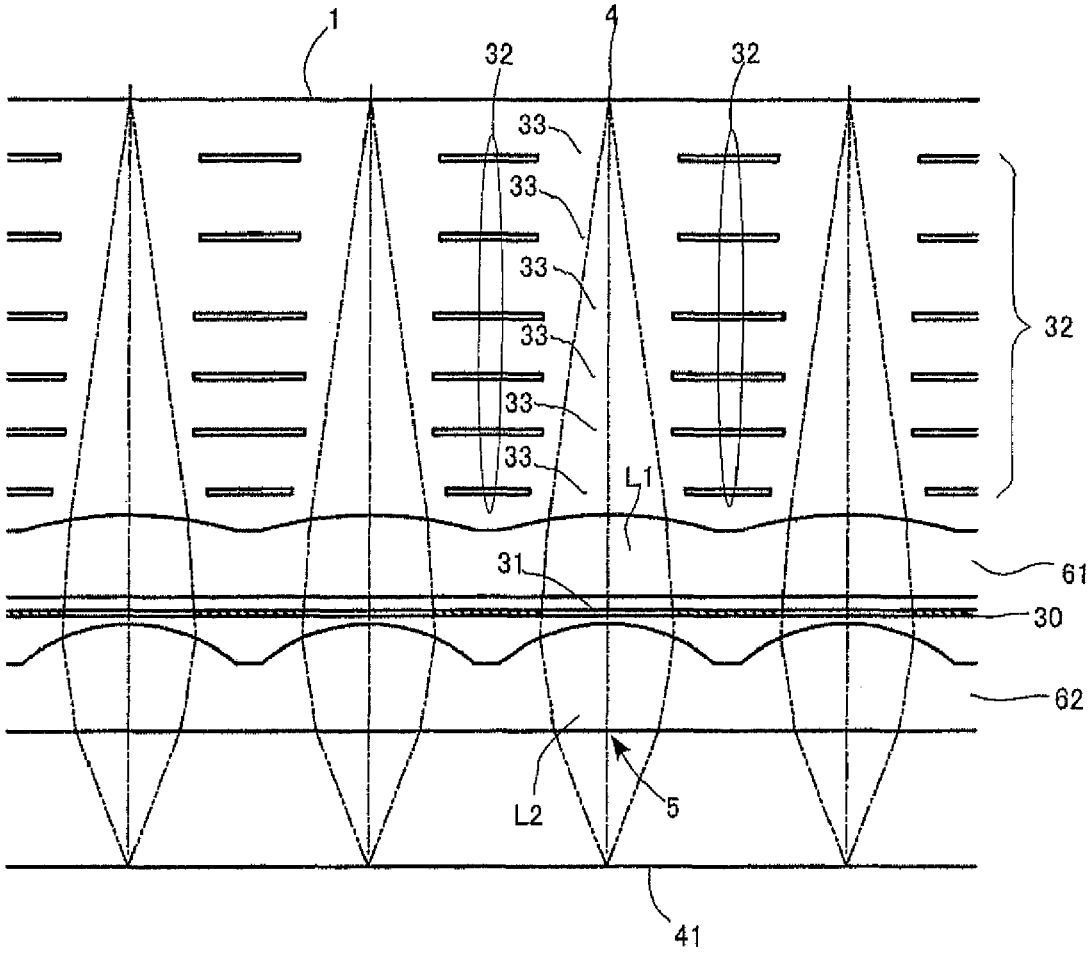
FIG. 31 is a cross-sectional view along the main-scanning direction showing another example of the optical system of the optical writing line head according to an embodiment of the invention provided with an anti-flare aperture plate in addition to the aperture plate.

In the optical system of the optical writing line head according to the embodiments of the invention as described above, in order to prevent the light from the light emitter block 4 entering the specific microlens 5 of the microlens array from entering the optical path of the adjacent microlens 5 to cause a flare, one or more anti-flare aperture plate(s) is preferably disposed between the light emitter array 1 and the aperture plate 30, between the aperture plate 30 and the microlens 5 (in the case shown in FIG. 13), or between the light emitter array 1 and the microlens 5 (in the case shown in FIG. 14). FIGS. 30 and 31 are cross-sectional views along the main-scanning direction showing an example of such a case. In FIG. 30, five anti-flare aperture plates 32 are disposed between the light emitter array 1 and the aperture plate 30, one anti-flare aperture plate 32 is disposed between the aperture plate 30 and the microlens 5, in parallel to the aperture plate 30 with predetermined intervals. In FIG. 31, six anti-flare aperture plates 32 are similarly disposed between the light emitter array 1 and the microlens 5, wherein each of the anti-flare aperture plates 32 is provided with apertures 33 corresponding respectively to the apertures 31 of the aperture plate 30. The aperture stop as intended in the embodiments of the invention denotes the aperture 31 of the aperture plate 30, but does not denote the apertures 33 of such anti-flare aperture plates 32.

In the case in which the light emitting elements 2 are disposed asymmetrically in the main-scanning direction with respect to the optical axis of the microlens 5 with the purpose of, for example, superfluously disposing the light emitting elements 2 forming each of the light emitter blocks 4 as shown in FIG. 24, by redefining the parameter $W_0$ in the embodiments of the invention as double the distance from the optical axis of the microlens 5 to the farthest light emitting element 2, it becomes possible to directly use the formulas (6)-(14) in view of the advantage (preventing ghost and loss of light intensity caused by cross talk) of the invention.

The line head and the image forming device using the line head according to the invention have been explained based on the principle and embodiments thereof. However, the invention is not limited to such embodiments, and various modifications are possible.

What is claimed is:

1. A line head comprising:

a lens array having a positive lens system in a first direction, the positive lens system having a pair of lenses with positive refractive power;

a light emitter array disposed on an object side of the lens array and having a plurality of light emitting elements disposed corresponding to the positive lens system; and an aperture plate forming an aperture stop on the object side of the pair of lenses, wherein where $f_1$ denotes a focal distance of one of the pair of lenses disposed on the object side, the following conditional formula is satisfied:

$$f_1 \leqq d_0/(1+W_0/D_1)$$

where $d_0$ denotes a distance between the light emitter array and a front principal surface of the lens on the object side; $W_0$ denotes a distance between light emitting elements located at both ends of the plurality of light emitting elements disposed corresponding to the positive lens system in the first direction; and $D_1$ denotes an effective diameter of the lens on the object side.

2. The line head according to claim 1, wherein the aperture stop is disposed at a front focal position of the positive lens system.

3. The line head according to claim 1, wherein an image side surface of at least the lens on the image side is formed of a flat surface.

4. The line head according to claim 1, wherein the light emitting element forms a light emitting element row arranged in a second direction perpendicular to the first direction.

5. The line head according to claim 1, wherein the light emitting element is arranged to form a light emitter group with interval in the first direction.

6. A line head comprising:

a lens array having a positive lens system in a first direction, the positive lens system having a pair of lenses with positive refractive power;

a light emitter array disposed on an object side of the lens array and having a plurality of light emitting elements disposed corresponding to the positive lens system; and an aperture plate forming an aperture stop on the object side of or between the pair of lenses, wherein where $f_1$ denotes a focal distance of one of the pair of lenses disposed on the object side, the following conditional formula is satisfied:

$$f_1 \leqq d_0/(1+W_0/D_1)$$

where $d_0$ denotes a distance between the light emitter array and a front principal surface of the lens on the object side; $W_0$ denotes a distance between light emitting elements located at both ends of the plurality of light emitting elements disposed corresponding to the positive lens system in the first direction; and $D_1$ denotes an effective diameter of the lens on the object side.

7. The line head according to claim 6, wherein the aperture stop is disposed at a front focal position of one of the pair of lenses disposed on an image side.

8. An image forming device comprising:

a latent image holding member;

a charging section for charging the latent image holding member;

a development section that develops the latent image holding member;

a line head including a lens array having a positive lens system in a first direction, the positive lens system having a pair of lenses with positive refractive power, a light emitter array disposed on an object side of the lens array and having a plurality of light emitting elements disposed corresponding to the positive lens system, and an aperture plate forming an aperture stop on the object side of or between the pair of lenses, satisfying the following conditional formula where $f_1$ denotes a focal distance of one of the pair of lenses disposed on the object side:

$$f_1 \leqq d_0/(1+W_0/D_1)$$

where $d_0$ denotes a distance between the light emitter array and a front principal surface of the lens on the object side; $W_0$ denotes a distance between light emitting elements located at both ends of the plurality of light emitting elements disposed corresponding to the positive lens system in the first direction; and $D_1$ denotes an effective diameter of the lens on the object side.

* * * * *